US006709306B2

(12) United States Patent
Brown

(10) Patent No.: US 6,709,306 B2
(45) Date of Patent: Mar. 23, 2004

(54) AQUATIC PROPULSION DEVICE

(76) Inventor: William Blake Brown, 218 Jo Dr., Los Gatos, CA (US) 95032

( * ) Notice: Subject to any disclaimer, the term of this patent is extended or adjusted under 35 U.S.C. 154(b) by 0 days.

(21) Appl. No.: 10/121,469

(22) Filed: Apr. 11, 2002

(65) Prior Publication Data

US 2002/0111093 A1 Aug. 15, 2002

Related U.S. Application Data

(63) Continuation-in-part of application No. 09/709,186, filed on Nov. 8, 2000.

(51) Int. Cl.[7] ..... A63B 31/10
(52) U.S. Cl. ..... 441/56; 441/59; 440/101
(58) Field of Search ..... 441/55–59; 440/101–104; D21/806, 807, 678; 416/63, 69, 70 R

(56) References Cited

U.S. PATENT DOCUMENTS

| | | | | | |
|---|---|---|---|---|---|
| 545,706 | A | * | 9/1895 | Mannes | 416/63 |
| 2,188,343 | A | | 1/1940 | Flournoy | |
| 2,290,943 | A | * | 7/1942 | Conley | 441/58 |
| 2,893,021 | A | * | 7/1959 | Lundborg | 416/63 |
| 3,109,184 | A | * | 11/1963 | Moore, Jr. | 416/63 |
| 3,407,419 | A | * | 10/1968 | Drummond | 441/56 |
| 3,518,024 | A | | 6/1970 | Wilson | |
| 3,786,526 | A | | 1/1974 | Ausseil | |
| 3,922,740 | A | | 12/1975 | Potter | |
| 4,068,610 | A | * | 1/1978 | Tesan | 440/101 |
| 4,129,912 | A | | 12/1978 | Robinson | |
| 4,233,925 | A | * | 11/1980 | Proctor | 440/101 |
| 4,509,744 | A | | 4/1985 | Beasley | |
| 4,521,011 | A | * | 6/1985 | Solloway | 482/111 |
| 4,888,846 | A | * | 12/1989 | Natale | 15/236.01 |
| 5,062,816 | A | * | 11/1991 | Berglund et al. | 440/101 |
| 5,364,296 | A | * | 11/1994 | Cerny | 440/101 |
| 5,378,217 | A | | 1/1995 | D'Orta | |
| 5,379,758 | A | * | 1/1995 | Snyder | 600/213 |
| 5,795,201 | A | * | 8/1998 | Tibbetts | 440/101 |
| 6,398,603 | B1 | | 6/2002 | Brown | |

FOREIGN PATENT DOCUMENTS

| | | | | |
|---|---|---|---|---|
| IT | 410205 | * | 4/1947 | 441/55 |

OTHER PUBLICATIONS watergates.com/flipper.html—regarding Flipper Product and associated pages.

* cited by examiner

*Primary Examiner*—S. Joseph Morano
*Assistant Examiner*—Ajay Vasudeva

(57) ABSTRACT

An aquatic propulsion device includes an elongate member, a forearm support secured to the elongate member, a grip secured to the elongate member, and a paddle secured to the grip. The grip is positioned such that a person may place their forearm in the forearm support and reach and hold onto the grip. While wearing the aquatic propulsion device, the person may perform power and/or return strokes using their forearm and hand, such that the forearm support, the elongate member, and the paddle move in tandem with the forearm and hand. The aquatic propulsion device is characterized by a center of water displacement that extends beyond the hand, away from the forearm.

33 Claims, 20 Drawing Sheets

AQUATIC PROPULSION DEVICE

CROSS REFERENCE TO RELATED APPLICATION

This application is a continuation-in-part of U.S. patent application Ser. No. 09/709,186, filed Nov. 8, 2000, and claims priority thereto.

FIELD OF INVENTION

This invention relates to human powered devices for enhancing propulsion in, through, or upon water.

BACKGROUND

Human powered aquatic propulsion devices are often used for purposes of sport, recreation, exercise, training, rescue, and/or rehabilitation. Aquatic propulsion devices exist in different configurations, some of which rely primarily upon lower body strength and others that primarily rely upon upper body strength. Aquatic propulsion devices that rely upon upper body strength frequently utilize hand paddles as a propulsion enhancement mechanism. Examples of aquatic propulsion devices utilizing hand paddles are given in U.S. Pat. Nos. 3,913,907; 3,922,740; 5,658,224; 5,288,254, and 4,913,418. Some aquatic propulsion devices utilize paddles or fins attached to a forearm, such as those described in U.S. Pat. Nos. 4,521,011 and 3,786,526.

Hand paddles enhance aquatic propulsion by displacing a greater amount of water for a given movement than would result from hand movement alone. Aquatic propulsion may also be enhanced through the leveraging of force over a distance greater than that defined by a human limb movement alone. As an example, the use of oars for rowing boats leverages force over distance, thereby increasing the efficiency of human work. Unfortunately, the hand and/or forearm paddles mentioned above fail to incorporate useful leveraging action. Such hand and/or forearm paddles may be characterized as providing a water displacement distance that is the same as or less than the movement of a hand, thereby undesirably limiting the extent to which they may enhance aquatic propulsion.

A hand paddle disclosed in U.S. Pat. No. 4,509,744 extends a center of displacement slightly beyond a hand, directly away from an arm. However, this invention is designed only as an exercise device to be utilized against the resistance of water. Due to design shortcomings, this and similar types of inventions would be of limited use relative to enhancing aquatic propulsion.

The torque generated by water resistance at the center of displacement and the force applied by a hand increase linearly with the distance between the center of displacement and the hand. This force must be countered by an equal but opposite force to keep a paddle substantially in plane with the hand and arm.

U.S. Pat. No. 4,509,744 discloses a hand paddle that uses a wrist guide, which reduces the turning moment about a user's wrist. Because of the proximity of the wrist to the hand relative to the distance from the hand to the center of water displacement, leveraged forces can become very great at the wrist. A wrist is typically bony and uneven on its top side, while its underside is soft, having many unprotected moving tendons. Thus, the wrist is not suitable for countering torque generated by an extended center of water displacement. The hand paddle design disclosed in U.S. Pat. No. 4,509,744 is therefore problematic relative to the stresses imposed upon a user's wrist.

A paddle may be defined as having a leading edge, which is the edge that first 'cuts' though the water on the return or non-power stroke during swimming. As the perpendicular distance of a paddle's leading edge relative to a hand or arm increases, the paddle's steering radius undesirably increases, and a user's margin for error and ability to perform directional adjustments decrease. This effect is similar to using the rear wheels of a car for steering. Unfortunately, prior hand and arm paddles fail to properly position the leading edge of the paddle relative to a user's arm or hand, thereby limiting their ease of use and effectiveness.

In addition to the aforementioned problems, the enhanced water displacement of hand and arm paddles can be disadvantageous or dangerous when hands and arms need to be used for actions other than swimming, for example, when taking pictures, picking up objects, or adjusting scuba or snorkeling apparatus. Removal of prior art hand and/or arm paddle assemblies can be problematic since such assemblies encumber both hands and arms.

DETAILED DESCRIPTION

Figure 1:
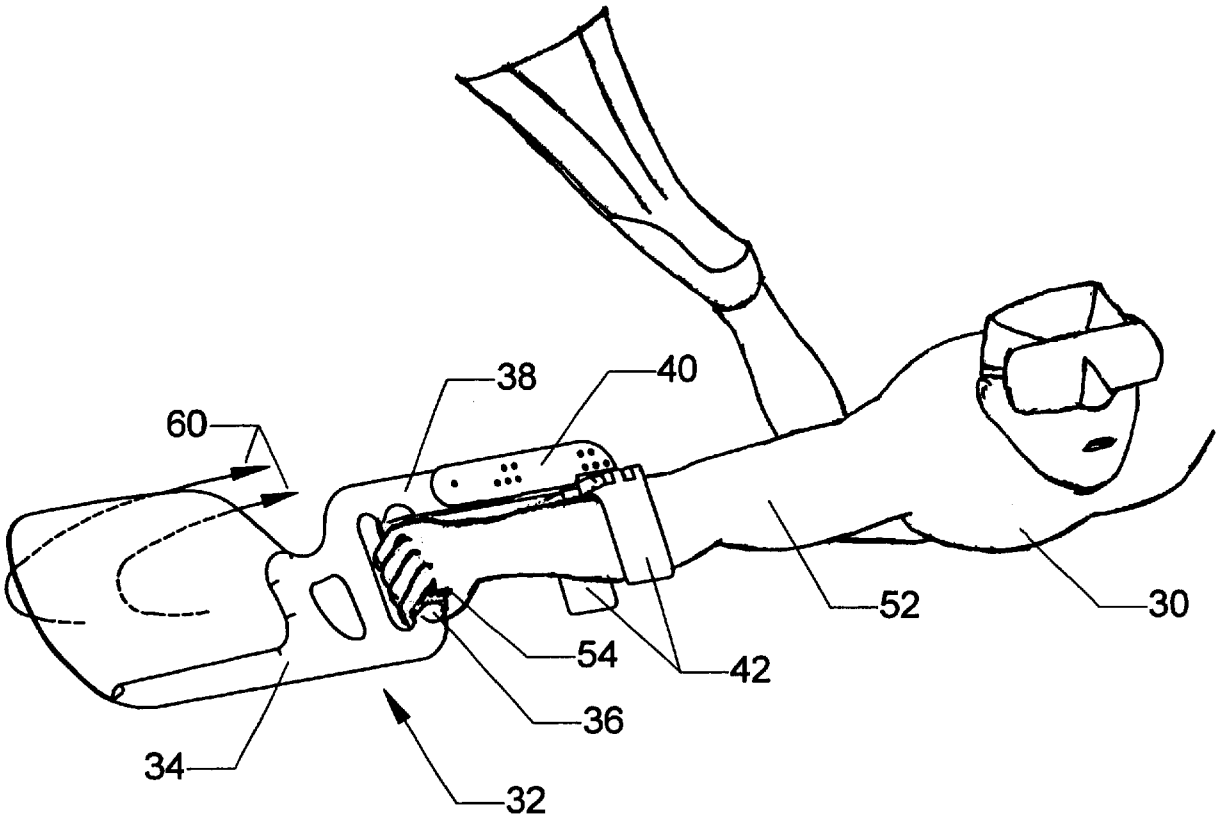
FIG. 1 is a drawing illustrating a diver using an aquatic propulsion device constructed in accordance with the present invention.

FIG. 1 of the accompanying drawings illustrates a person 30 using an aquatic propulsion device 32 according to an embodiment of the invention. The aquatic propulsion device 32 comprises a paddle 34, a hand grip 36, a forearm member mount 38, an elongated forearm member 40, and a forearm support 42. In use, the person 30 inserts an arm 52 into the forearm support 42, and uses a hand 54 to hold or grasp the hand grip 36. The person 30 alternately employs or performs propulsive, or power, strokes, followed by return, or non-power, strokes with the present invention to propel themselves through water.

Relative to propulsive strokes, movement of the arm 52 and hand 54 along the general direction of a propulsive axis, arc, or travel path 60 applies a force to the hand grip 36. This force in turn causes the paddle 34, which is oriented or held generally perpendicular to the propulsive axis 60 during the propulsive stroke, to displace a significant amount of water along the direction of the axis 60, thereby propelling the person 30 forward. The person 30 may adjust the particular orientation of the axis 60 by rotating their arm 52 and hand 54, which in turn may adjust the direction of propulsion during use.

Relative to return strokes, movement of the arm 52 and hand 54 along a return path (not shown) such that the paddle 34 is held or oriented generally parallel to the return path to minimize the amount of water displaced by the aquatic propulsion device 32 effectively returns the aquatic propulsion device 32 to a position from which another power stroke may originate. Those skilled in the art will understand that a return stroke may generally retrace some or all of a power stroke, and that a return stroke may be used to reorient the aquatic propulsion device 32 to a new position prior to a power stroke.

Figure 2:
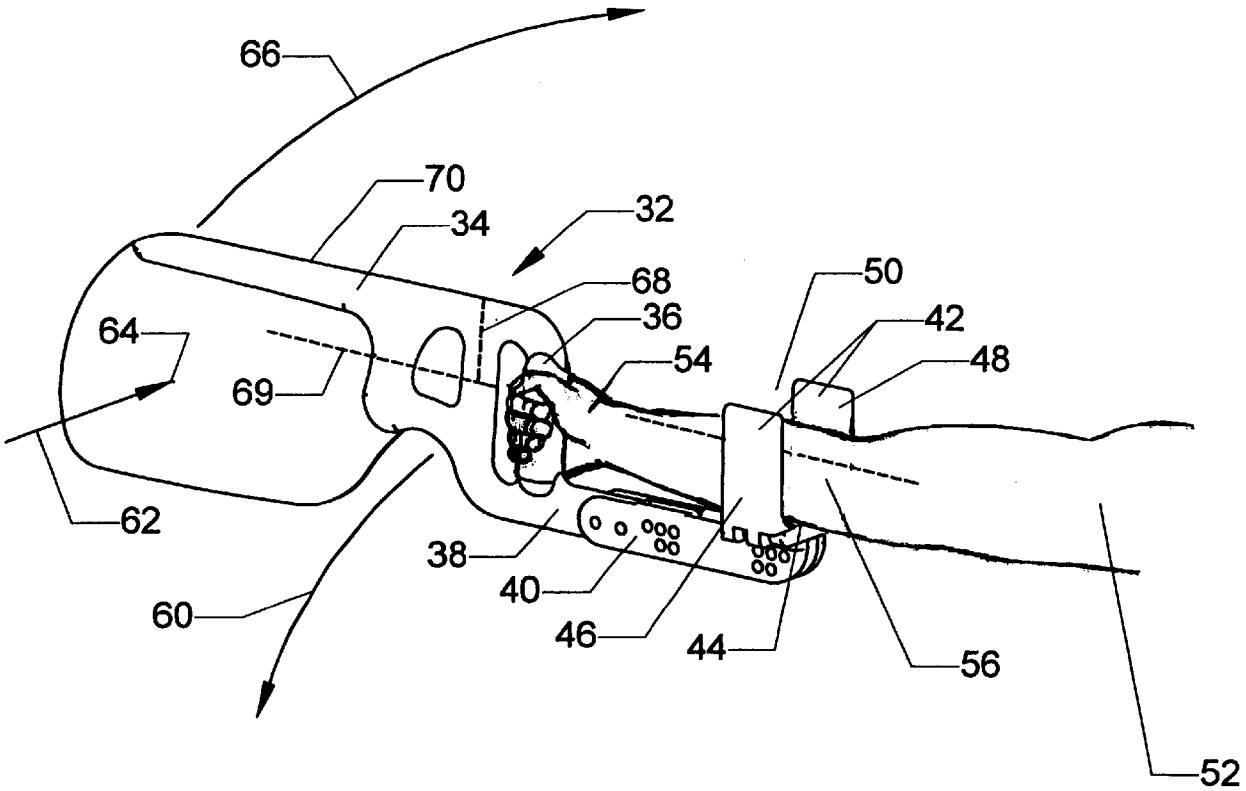
FIG. 2 is a perspective view showing a user's arm position while holding an aquatic propulsion device constructed in accordance with the present invention.

Referring also now to FIG. 2, a perspective view shows an aquatic propulsion device 32 supporting a user's arm 52. The forearm support 42 may be generally u-shaped, and includes a support bottom 44, a support front 46, a support back 48 and a support opening 50. The support bottom 44 is secured to the elongated forearm member 40, and the support front 46 and support back 48 are secured to the support bottom 44. Depending upon particular embodiment details, the support front 46 and/or the support back 48 may form a single, integral unit with the support bottom 44. The support opening 50 is formed by a space between the support bottom 44, the support front 46 and the support back 48. A person 30 using the present invention inserts a forearm 56 into the support opening 50, such that the forearm 56 is positioned against or upon the support bottom 44, the support front 46, and the support back 48.

Opposing ends of the hand grip 36 are secured to the paddle 34. One end of the forearm member mount 38 is secured to the paddle 34, and an opposing end of the forearm member mount 38 is secured to one end of the elongated forearm member 40. In response to a person's hand 54 applying a force against the hand grip 36 along the axis 60, water resists the movement of the paddle 34 and creates a resistive force 62. The resistive force 62 may be effectively characterized by a resistive center 64. Increasing the distance between the resistive center 64 and the hand grip 36 directly away from the arm 52 advantageously enhances aquatic propulsion by leveraging force over a distance or arc length greater than that defined by hand movement alone. As an analogy, the use of paddles for rowing canoes leverages force over distance, thereby increasing the efficiency of human work. The present invention's leveraging of force significantly enhances a user's propulsion through water relative to prior types of devices such as conventional hand paddles.

The resistive force 62 at the resistive center 64 generates a rotational moment 66 about the hand grip 36. Those skilled in the art will understand that movement of the paddle 34 along or about the rotational moment 66 should generally be restricted or limited to maximize the amount of water the paddle 34 displaces.

Through the aforementioned leveraging action, the torque generated by the rotational moment 66 proximate the hand 54 may be quite significant, and thus the hand 54 alone may have difficulty countering the rotational moment 66. The present invention addresses this situation via the forearm support 42. In particular, the support back 48 provides a surface capable of bearing pressures applied by the forearm 56 to counter the rotational moment 66 around the hand grip 36. The distance between the hand grip 36 and the forearm support 42 reduces the leveraging action of the rotational moment 66 proportional to the distance between the hand grip 36 and the resistive center 64. Therefore, the force applied by the support back 48 against the forearm 56 is significantly reduced relative to a force that would otherwise be required proximate the hand 54 or wrist. Moreover, a person's forearm 56 tends to be muscular, and can therefore more easily and comfortably bear the force applied by the support back 48. One skilled in the art will recognize that movement of the arm 52 and the hand 54 opposite to the axis 60 results in the generation of oppositely-directed forces that can be countered to the same effect and advantage by the forearm 56 against the support front 46 of the forearm support 42.

At times, a person's arms 52 and hands 54 may be required for actions other than aquatic propulsion, for example, taking pictures, picking up objects, and/or adjusting scuba or snorkeling gear. In one embodiment, by simply releasing the hand grip 36, the resistive effect of water and/or gravitational forces allow the user 30 to freely remove their arm 52 and hand 54 from the aquatic propulsion device 32. The present invention may advantageously provide simple, rapid, and unaided removal of the arm 52 and hand 54 to maximize both safety and convenience.

Figure 3:
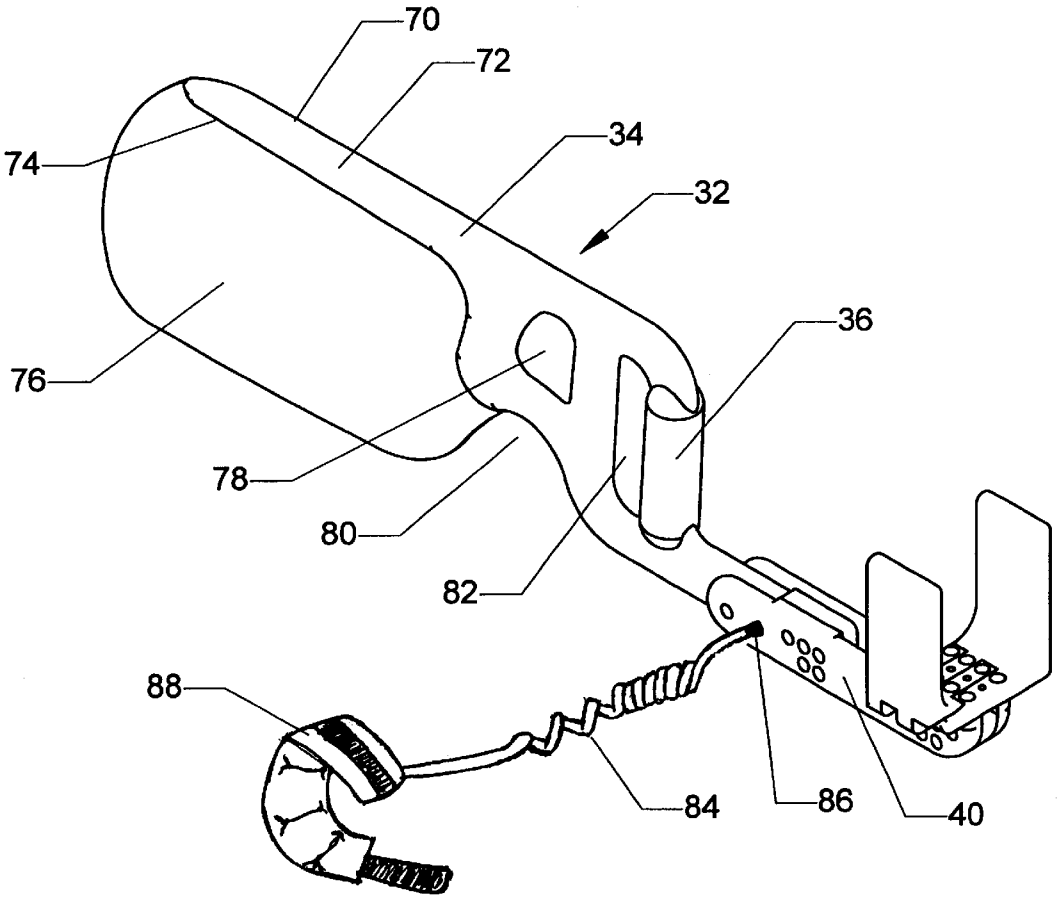
FIG. 3 is a perspective view of an aquatic propulsion device constructed in accordance with the present invention.

Referring also now to FIG. 3, a perspective view shows additional details of an aquatic propulsion device 32 constructed in accordance with the present invention. The embodiment shown in FIG. 3 includes a tether 84, which may be employed to prevent the aquatic propulsion device 32 from drifting, floating, sinking or otherwise undesirably moving away when the person 30 releases or disengages their hand 54 and arm 52 from the aquatic propulsion device 32. The tether 84 may be added to or included in any particular embodiment of aquatic propulsion device 32. In one embodiment, a first end of the tether 84 may be secured to the elongated forearm member 40 using a tether pin 86. An opposing end of the tether 84 may be secured to an arm strap 88. The arm strap 88 may be secured as desired along the arm 52 using, for example, a Velcro strap, a buckle, or other attachment mechanism as would be well understood by one skilled in the art. In another embodiment, the tether 84 and/or the aquatic propulsion device 32 itself may be secured to the person 30 at a swimming suit, a waist belt, a diving vest, a life vest or a wet/dry suit using a Velcro strap, a buckle, a clip, a carabiner or other type of conventional attachment mechanism.

FIG. 3 additionally shows that the paddle 34 includes a leading edge 70; a rigidifying support 72 having a trailing side 74; a resistive surface 76; a spacing hole 78; a spacing recess 80; and a hand grip hole or opening 82. The rigidifying support 72 lies along or upon the paddle's leading edge 70. The resistive surface 76 may be secured to the paddle 34 along the rigidifying support's trailing side 74. Those of ordinary skill in the art will readily understand that the rigidifying support 72 and resistive surface 76 may be constructed in alternative shapes and designs, including variations in widths and lengths. Those skilled in the art will further understand that the rigidifying support 72 may be divided or "splayed out" into multiple generally-rigid members or "fingers" across the resistive surface 76, in a manner similar to the fingers or divisions found in a bat wing.

The spacing hole 78 and the spacing recess 80 may be cut, drilled, formed, or otherwise placed in the rigidifying support 72 proximate the hand grip 36 to focus water displacement on the resistive surface 76. This, in turn, moves the resistive center 64 further away from the hand grip 36, advantageously increasing the efficiency of aquatic propulsion. The hand grip hole 82 may be cut, drilled, formed or otherwise placed in the rigidifying support 72 to allow for comfortable and secure placement of the hand 54 around the hand grip 36.

The paddle's leading edge 70 may be defined as an edge or side that first 'cuts' or 'slices' through the water on a return or non-power stroke during swimming. Referring again to FIG. 2, the paddle 34 may be further characterized as having a steering radius 68, defined by a perpendicular distance from the leading edge 70 to a line 69 running through the hand 54 and the forearm 56. The present invention teaches that the leading edge 70 should be inline or generally proximate and parallel to the line 69 running through the hand 54 and the forearm 56. In other words, the steering radius 68 should not typically extend much past the hand 54, thereby enhancing a user's ability to perform directional adjustments. When the steering radius 68 is small, the effect is similar to steering an automobile with its front wheels; however, as the steering radius is extended, the effect is similar to steering an automobile with its rear wheels. The small steering radius 68 provided by the present invention advantageously aids user control, in contrast to prior types of devices directed toward enhancing human propulsion in water. In an exemplary embodiment, the steering radius is approximately three inches.

The hand grip 36, the forearm member mount 38, the elongated forearm member 40, the forearm support 42 and the rigidifying support 72 may be constructed using material that is rigid, strong, light weight, UV protected and corrosion resistant, as well as attractive and hydrodynamic. In some embodiments, it may be advantageous for the rigidifying support 72 to have some amount of flexibility in order redirect forces, channel water flow and relieve stress. Many conventional types of plastics, rubber, metal alloys or the like would be suitable for construction of the present invention. For example, High-Density Polyethylene (HDPE), Aluminum, Titanium, and/or Carbon fiber materials may be employed in construction of the present invention.

The resistive surface 76 may be constructed using material that is flexible, strong, light weight, UV protected and corrosion resistant, as well as attractive and hydrodynamic. Many conventional types of plastic, rubber, metal alloys or the like, would be suitable, including one or more of the aforementioned materials. The desired flexibility of the resistive surface 76 may depend on the particular application of the present invention, and may be determined by material type and/or material thickness. For example, a novice user 30 may desire greater flexibility to reduce fatigue, while a more experienced user 30 may want less flexibility for higher performance. The resistive surface 76 may be manufactured from the same material as the rigidifying support 72, but typically manufactured thinner in order to provide a desired amount of flexibility. This allows the paddle 34 to be manufactured using a single injection molding process. The boundary between the rigidifying support 72 and the resistive surface 76 may be abrupt, or a gradual taper as best suits any given application. Alternatively, the resistive surface 76 may be constructed using a material different from that of rigidifying support 72, and laminated, bolted, welded, or otherwise secured to the rigidifying support 72.

The desired buoyancy or density of the material or materials used to manufacture the aquatic propulsion device 32 may be selected based upon application. For example, scuba and underwater applications may require materials characterized by neutral or slightly negative buoyancy, while snorkeling and surface water applications may find materials providing increased buoyancy advantageous.

As with many manufactured products, cost, manufacturability, and intended application relative to any given choice of materials must be considered. The aforementioned elements may be manufactured from conventional materials using conventional injection molding, machining and/or similar techniques.

Figure 4:
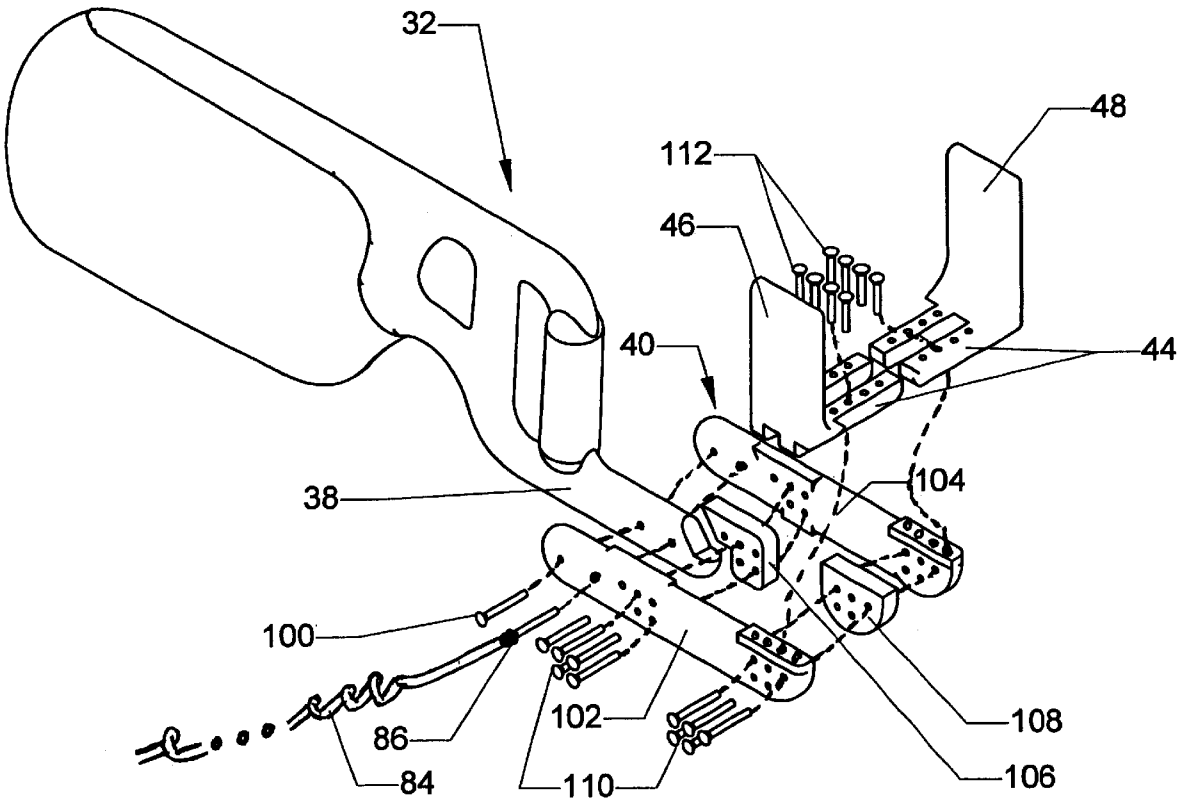
FIG. 4 is an exploded perspective view of an aquatic propulsion device constructed in accordance with the present invention.

FIG. 4 illustrates an exploded view of an aquatic propulsion device 32 constructed in accordance with the present invention. A rotational attachment screw 100 may be used to secure the forearm member mount 38 to the elongated forearm member 40. The tether pin 86 may also be used to further secure the forearm member mount 38 to the elongated forearm member 40, in addition to securing one end of the tether 84 to the aquatic propulsion device 32.

The elongated forearm member 40 comprises a front elongated member 102, a back elongated member 104, a rotational stop 106, a spacing component 108 and a set of forearm member screws 110. The forearm member screws 110 may be used to secure the front elongated member 102 to a first side of the rotational stop 106 and a first side of the spacing component 108. The forearm member screws 110 may continue through the rotational stop 106 and the spacing component 108, and may also be used to secure an opposing side of the rotational stop 106 and an opposing side of the spacing component 108 to the back elongated member 104. A set of forearm support screws 112 may be used to secure the support bottom 44 to the elongated forearm member 40, such that the support front 46 and the support back 48 are slidably adjustable to comfortably and securely fit the forearm 56. Those skilled in the art will recognize that various embodiments of the aquatic propulsion device 32 may rely upon additional, fewer, and/or different types of securing elements than those shown in FIG. 4.

Figure 5:
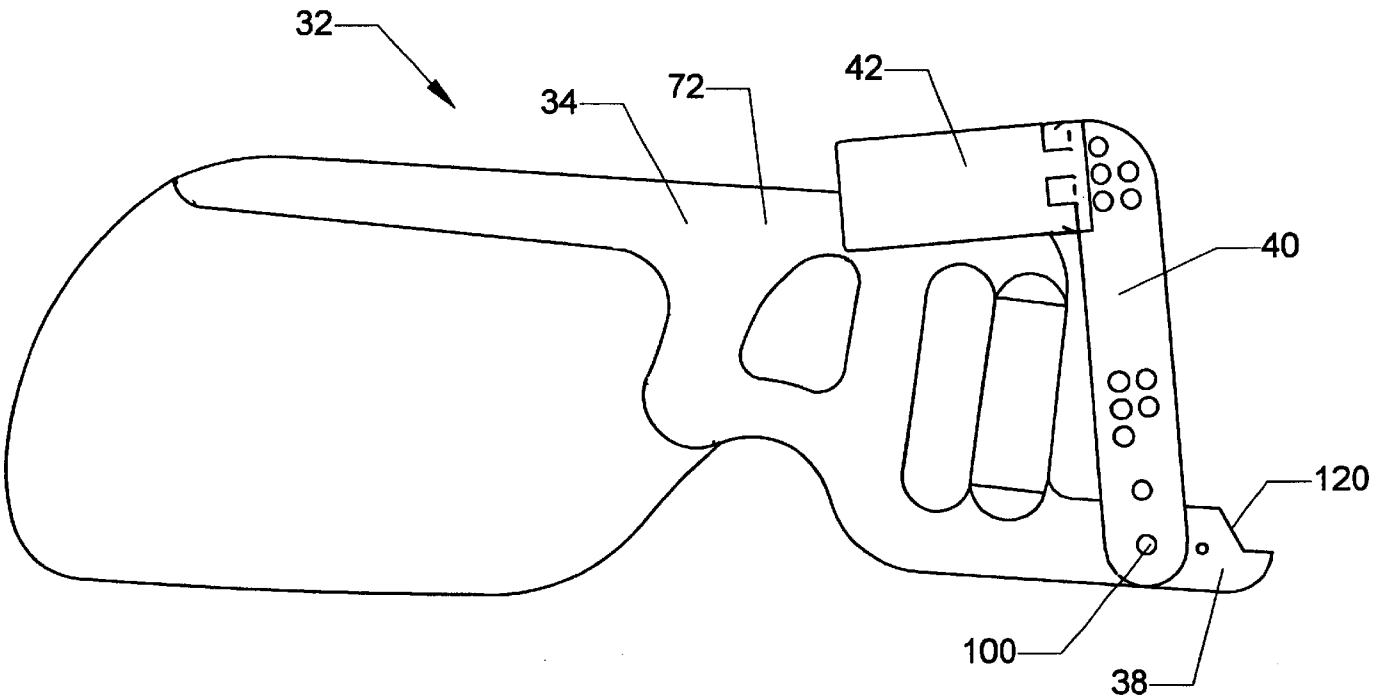
FIG. 5 is a side view of an aquatic propulsion device folded into a storage position.

FIG. 5 shows an aquatic propulsion device 32 folded into a storage position. The storage position reduces overall length to facilitate ease of transportation and/or storage. The elongated forearm member 40 and forearm support 42 may rotate around the rotational attachment screw 100 relative to the forearm member mount 38 and paddle 34. In the folded storage position, the rotation of the elongated forearm member 40 and forearm support 42 is arrested or limited by the paddle's rigidifying support 72.

Figure 6:
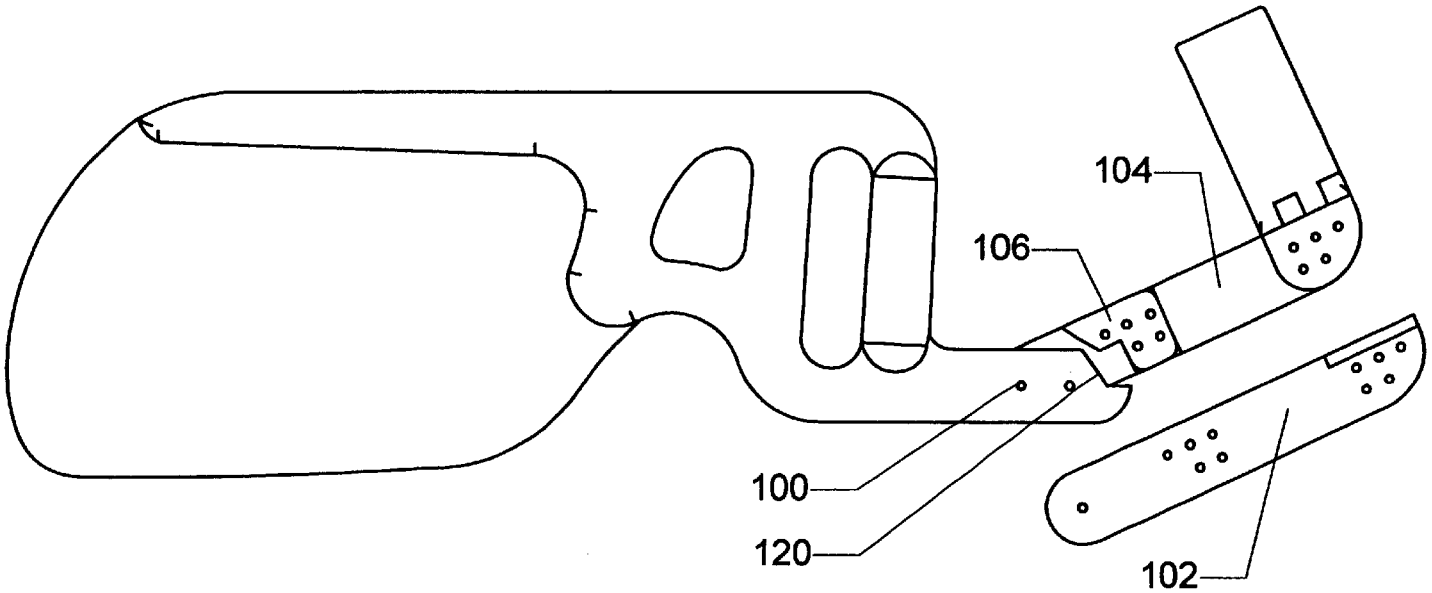
FIG. 6 is a side view showing structural elements that facilitate the folded storage position of FIG. 5.

FIG. 6 shows an aquatic propulsion device in an exemplary partially-folded position, wherein the front elongated member 102 has been removed to expose the structural interaction of the forearm member mount 38 and the rotational stop 106. In a fully extended or usage position, as illustrated in FIGS. 1 through 4, the rotation of the elongated forearm member 40 may be arrested when the rotational stop 106 contacts a keyed stop 120 of the forearm member mount 38.

Figure 7:
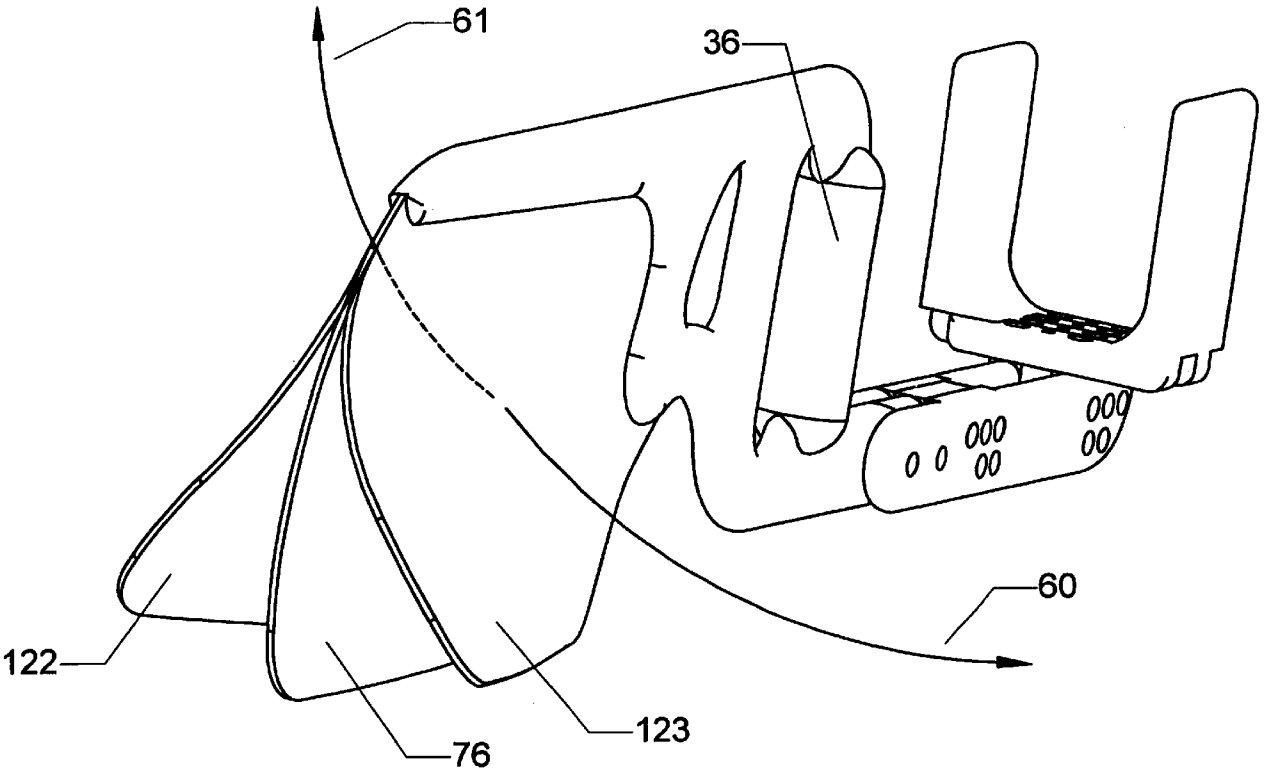
FIG. 7 is a perspective view showing exemplary first, second, and third paddle flex patterns.

FIG. 7 illustrates a first and a second resistive surface flex pattern 122, 123 that result when a person's hand 54 applies a force against the hand grip 36 along a first axis 60 and a second direction, axis, arc or travel path 61 that is generally opposite the first axis 60, respectively. The magnitudes of the first and second flex patterns 122, 123 are dependent on 1) the amount of force applied to the hand grip 36 along the first and second axes 60, 61, respectively; and 2) the rigidity and thickness of the material used to construct the resistive surface 76. As mentioned above, increased flexibility may reduce a novice user's fatigue, while increased rigidity may increase power and control for a more experienced user.

Figure 8A:
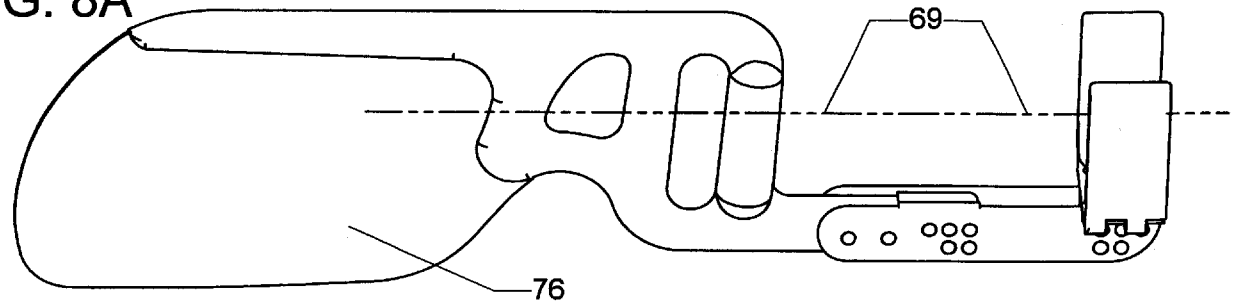
FIGS. 8A, 8B, and 8C are side views respectively showing a first, a second, and a third exemplary rotational orientation of the aquatic propulsion device relative to a user's arm rotation.
Figure 8B:
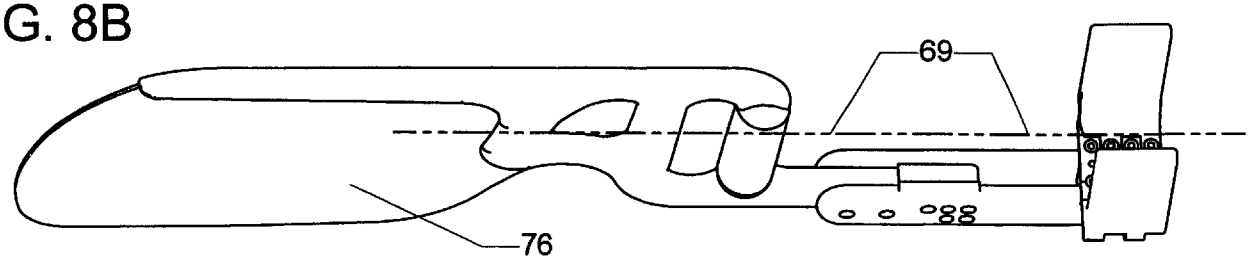
Figure 8C:
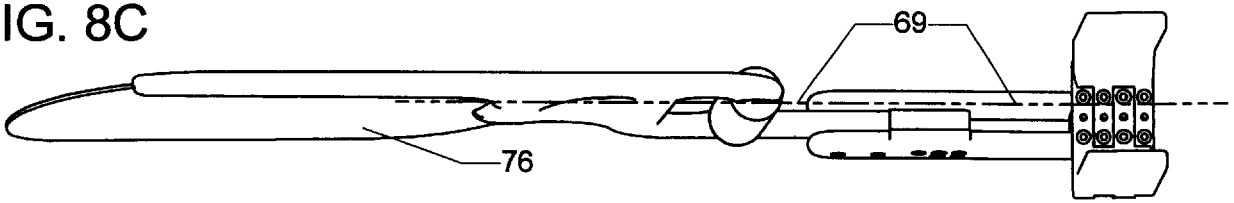

FIGS. 8A, 8B and 8C are side views of an aquatic propulsion device 32 showing various degrees of a rotation orientation around the line 69 running through the hand 54 and the forearm 56. Each of these rotational orientations is exemplified by rotating a user's hand 54 while leaving the forearm 56 and arm 52 in place. One skilled in the art will recognize that the rotational orientations illustrated in FIGS. 8A, 8B and 8C are for descriptive purposes only and represent an essentially infinite range of rotational orientations around the line 69. Rotation of the aquatic propulsion device 32 around the line 69 may be used to 1) steer the aquatic propulsion device during the return or non-power stroke during swimming; and/or 2) adjust the exposure and thereby degree of water displacement by the resistive surface 76 during the power stroke while swimming.

Figure 9:
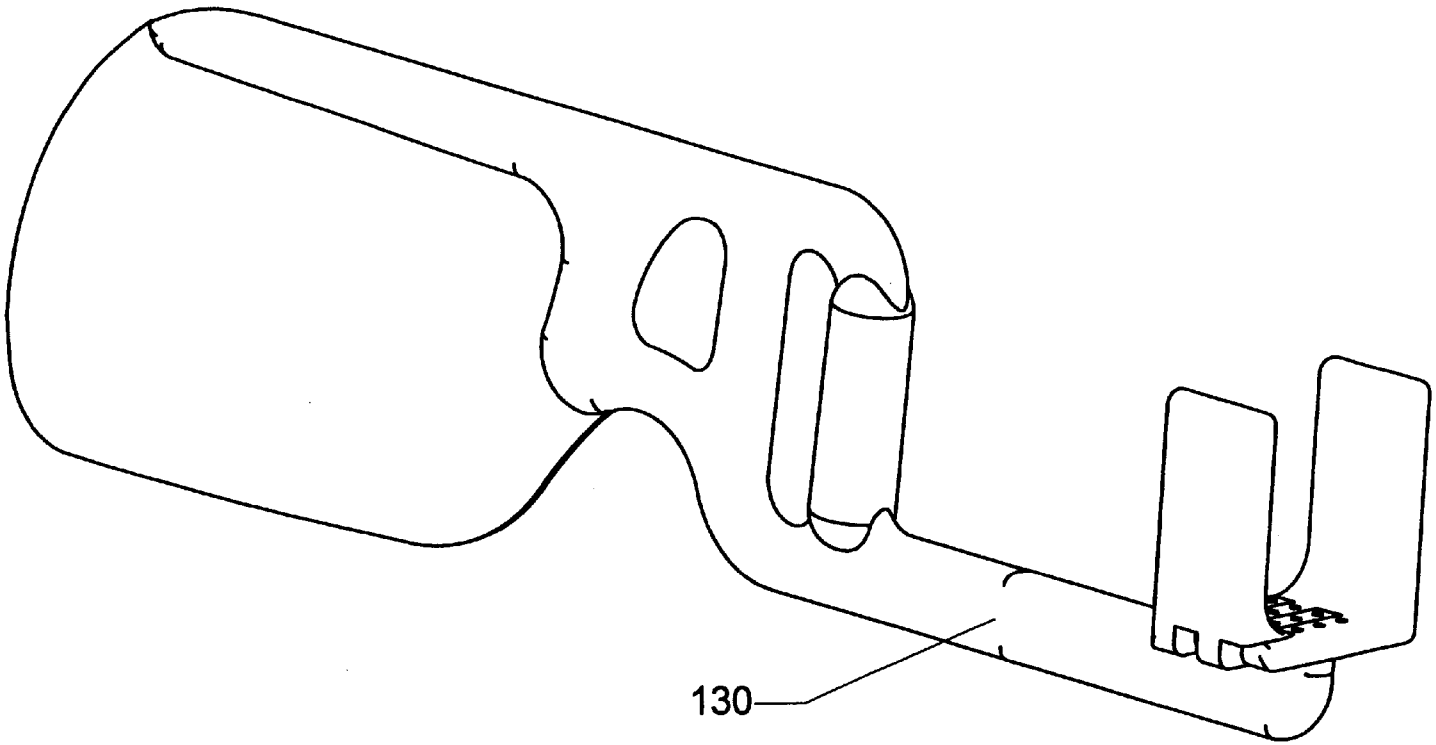
FIG. 9 is a perspective view of a first alternate embodiment of an aquatic propulsion device constructed in accordance with the present invention.

FIG. 9 is an illustration of an alternate embodiment of an aquatic propulsion device 32 in which the forearm member mount 38 and the elongated forearm member 40 are secured by construction as a single rigid forearm member 130. This embodiment simplifies the construction and reduces the amount of material and components required manufacture the aquatic propulsion device 32. Such an embodiment may also improve the hydrodynamic properties of the invention. However, the storage position, as shown in FIG. 5, is not possible in this embodiment. This alternative embodiment may be advantageous for applications where performance and cost outweigh the convenience of the storage position for transportation and storage. One skilled in the art will see that there are any number of embodiments relative to the construction of the forearm member mount 38 and the elongated forearm member 40, including, but not limited to, an embodiment in which they are secured by bolts, latches and/or a telescoping mechanism, thereby providing some of the advantages of the single rigid forearm member 130 while allowing for detachment to facilitate transportation and/or storage.

Figure 10:
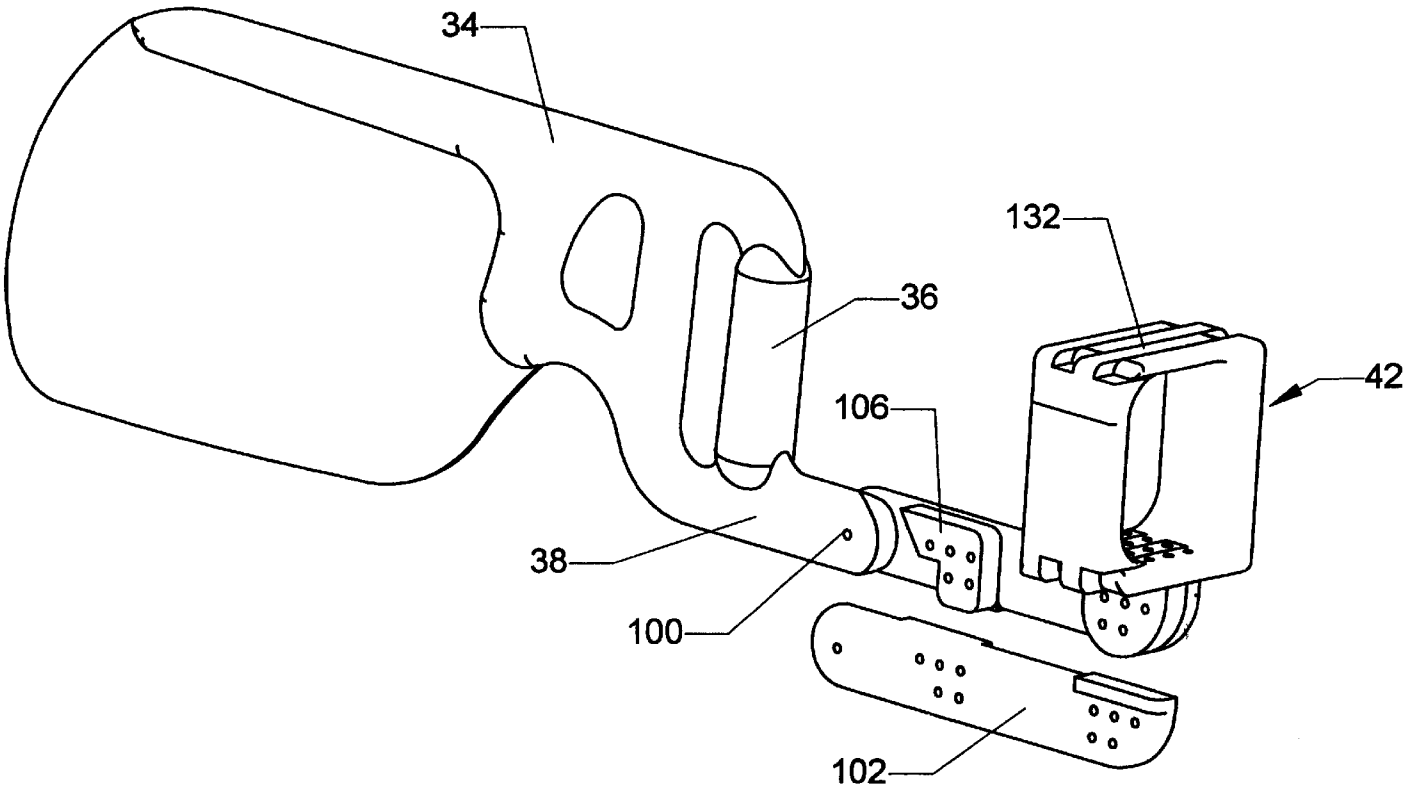
FIG. 10 is a perspective view of a second alternate embodiment of an aquatic propulsion device constructed in accordance with the present invention.
Figure 11:
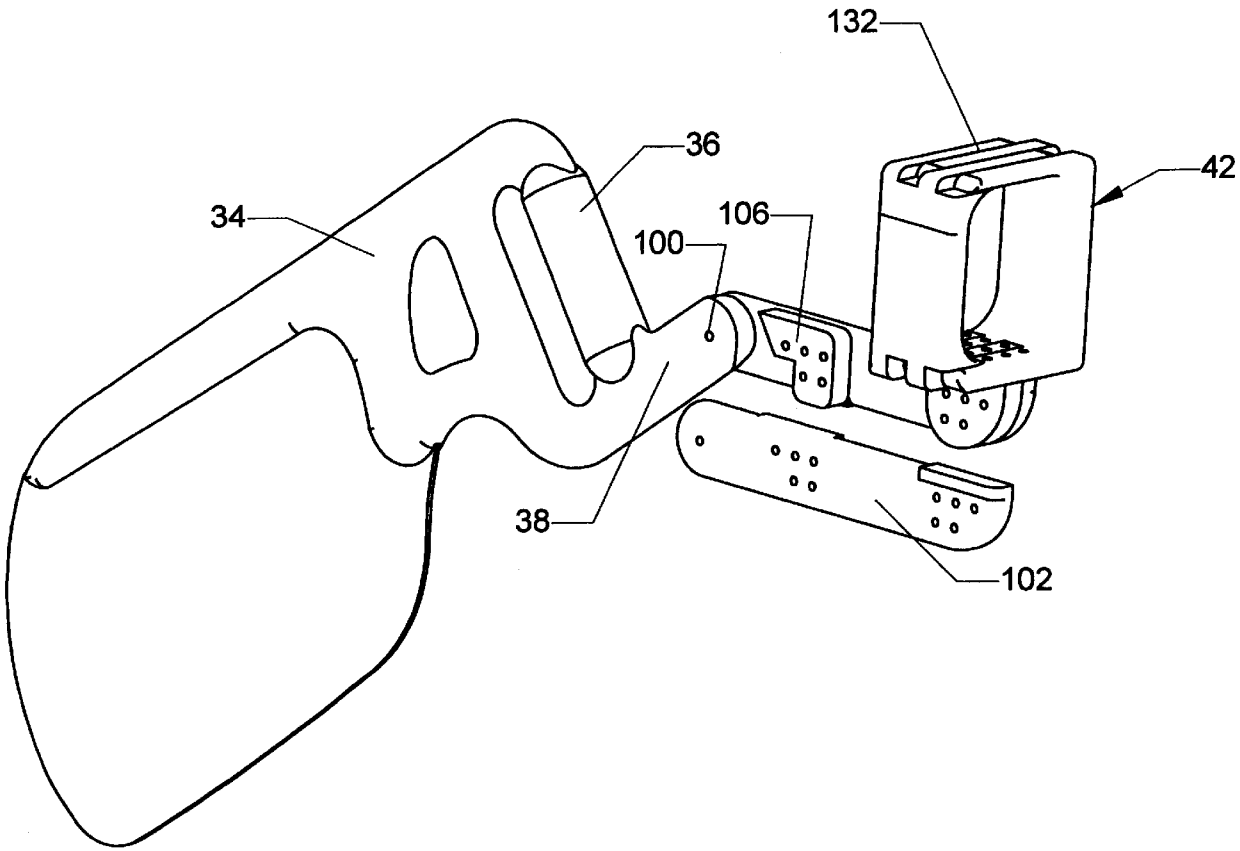
FIG. 11 is a perspective view showing structural elements that facilitate a disengaged position for the aquatic propulsion device of FIG. 10.

FIGS. 10 and 11 illustrate another embodiment of the present invention in which the forearm support 42 includes a support top 132 to facilitate a full encircling of the forearm 56. For purpose of example, the front elongated member 102 has been removed in FIGS. 10 and 11 to expose the structural interaction of the forearm member mount 38 and the rotational stop 106. As can be seen in FIGS. 10 and 11, the forearm member mount 38 may rotate around the rotational attachment screw 100 unencumbered by the rotational stop 106, thereby allowing the forearm member mount 38 and paddle 34 to swing out of the way of the hand 54 when the hand grip 36 is released. In such an embodiment, the tether 84, as shown in FIGS. 3 and 4, is not necessary because when released, the aquatic propulsion device 32 is prevented from drifting, floating, sinking or otherwise undesirably moving away from the person 30 by the forearm support 42. This embodiment may be advantageous when unimpeded movement of the forearm 56 and arm 52 are not required. Those skilled in the art will understand that in yet another embodiment, one or more portions of the forearm support 42 could comprise a strap, which may be implemented, for example, using Velcro™ or other material.

Figure 12:
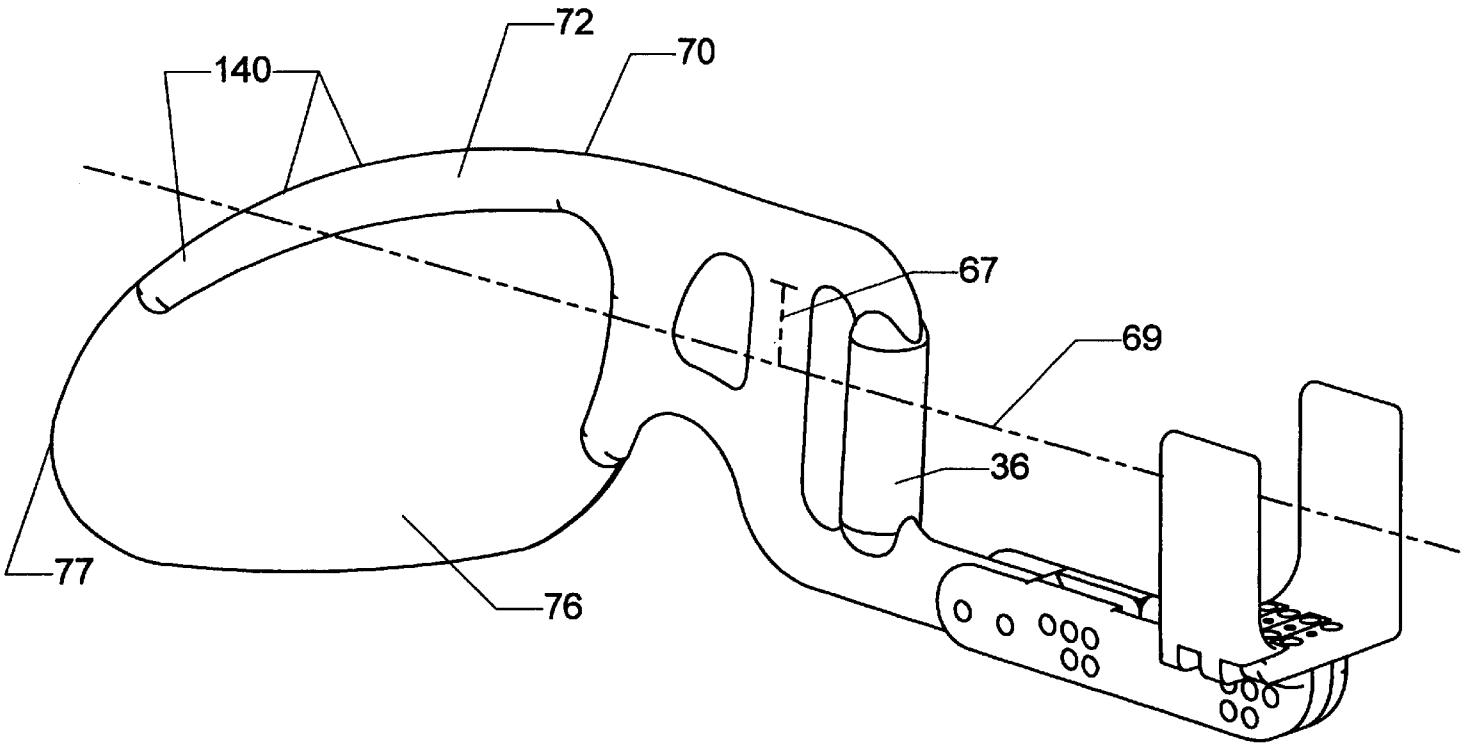
FIG. 12 is a perspective view showing a third alternate embodiment of an aquatic propulsion device constructed in accordance with the present invention.
Figure 13:
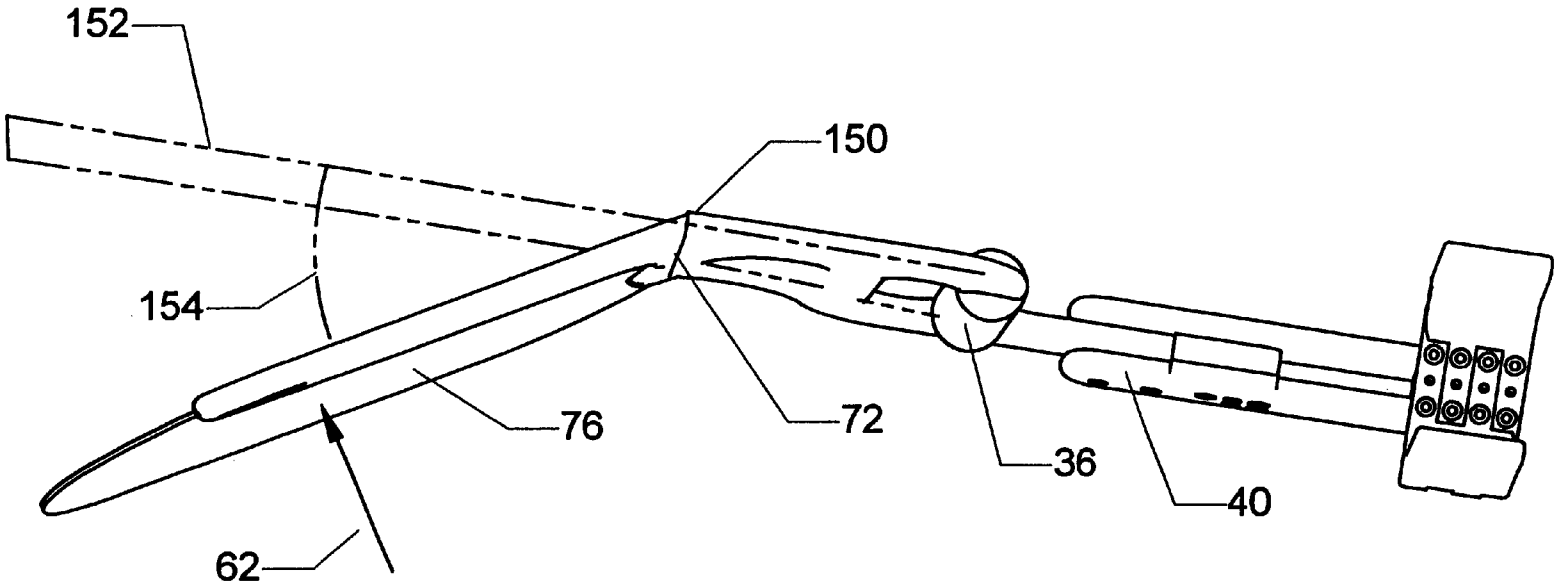
FIG. 13 is a perspective view showing a fourth alternate embodiment of an aquatic propulsion device constructed in accordance with the present invention.

FIG. 12 illustrates an embodiment of an aquatic propulsion device 32, as taught by the present invention, wherein the leading edge 70, rigidifying support 72 and the resistive surface 76 have or include a downward taper 140 on an end opposing the hand grip 36. The downward taper 140 curves down and past the line 69 running through the hand 54 and the forearm 56; that is, the downward taper 140 curves toward a line essentially parallel to the elongated forearm member 40. The downward taper 140 significantly reduces an average or effective steering radius 67, defined as an average distance between the line 69 and the leading edge 70, thereby increasing control and reducing the torque required to make directional adjustment to the paddle 34 through the water on the return or non-power stroke while swimming. In an exemplary embodiment, the effective steering radius 67 is approximately one inch; and the downward taper 140 curves such that the vertical distance or offset between the leading edge 70 and a tip or end 77 of the paddle's resistive surface 76 is approximately four inches. Those skilled in the art will recognize that the effective steering radius 67 and the extent of the downward taper 140 may vary in accordance with particular embodiment details. FIG. 13 illustrates yet another embodiment of the present invention, in which a bend 150 is formed in the rigidifying support 72, thereby moving the resistive surface 76 out of a plane 152 formed by opposing ends of the hand grip 36 and the length of the elongated forearm member 40. The bend 150 may be characterized by an angle 154 formed between the resistive surface 76 and the plane 152. The angle 154 modifies the exposure of the resistive surface 76 to the water relative to the movement of the arm 52 during a power stroke while swimming. Various degrees of angle 154 may be advantageous for redirecting the resistive force 62 of the resistive surface 76 against the water in a more forward direction during a strongest portion of the arm's movement while swimming. This in turn may improve or enhance the aquatic propulsion properties of the present invention. In an exemplary embodiment, the angle 154 is approximately 15 degrees. Those skilled in the art will see that many different angles may be advantageous depending upon 1) the swimming application, such as, speed, distance, sport, or recreational use; and/or 2) the skill of the user. Those skilled in the art will also understand that an embodiment that incorporates the bend 150 may also incorporate the downward taper 140 shown in FIG. 12.

Figure 14B:
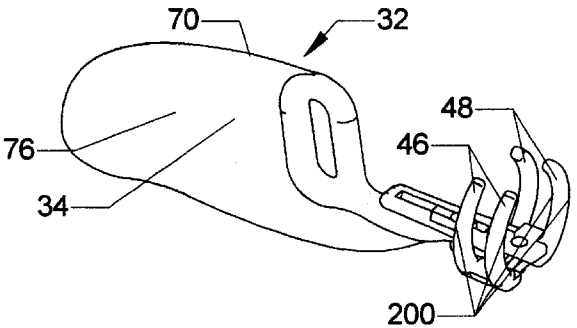
FIGS. 14A and 14B are a side and perspective view respectively showing a fifth alternate embodiment of an aquatic propulsion device with a curved forearm support constructed in accordance with the present invention.
Figure 14A:
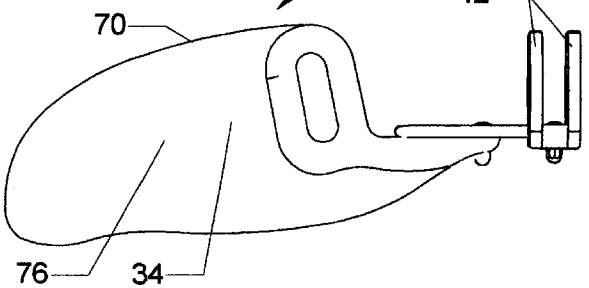

FIG. 14A and FIG. 14B are illustrations of an alternate embodiment of an aquatic propulsion device 32 in which the forearm support front 46 and the forearm support back 48 have a curved profile 200, giving the forearm support 42 a c-shaped or generally c-shaped profile. Referring also now to FIG. 15A, an end view of an aquatic propulsion device 32 through the forearm support 42, exemplifying the curved profile 200 of the forearm support front 46 and the forearm support back 48 and the generally c-shaped forearm support 42, is shown. The effectiveness of the forearm support 42 in counter balancing a resistive action of the water against the resistive surface 76 during swimming motions or strokes is significantly enhanced by the curved profile 200 of the forearm support front 46 and the forearm support 48, especially in a generally upward and inward direction 202 against the forearm support front 46 and a generally upward and outward direction 204 against the forearm support back 48.

FIG. 2 depicts a person's forearm 56 placed or inserted into a previously described embodiment of the invention. Relative to a person's forearm 56 placed or inserted into the embodiment shown in FIGS. 14A, 14B, and 15A, the curved profile 200 of the forearm support front 46 and the forearm support back 48 improves comfort by better conforming to a curved shape of the person's forearm 56. The curved profile 200 also distributes resistive forces against more surface area of the person's forearm 56, thereby reducing pressure points. This force distribution and pressure point reduction may be particularly advantageous during swimming motions or strokes during which the device 32 may be mostly or entirely underwater, and/or in use for significant periods of time.

Figure 15B:
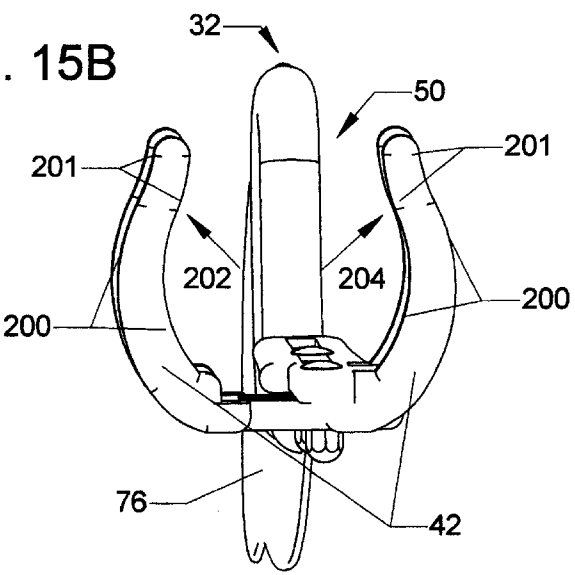
FIGS. 15A and 15B are end views exemplifying a curved profile of a forearm support for the aquatic propulsion device of FIGS. 14A, 14B and 14C.
Figure 15A:
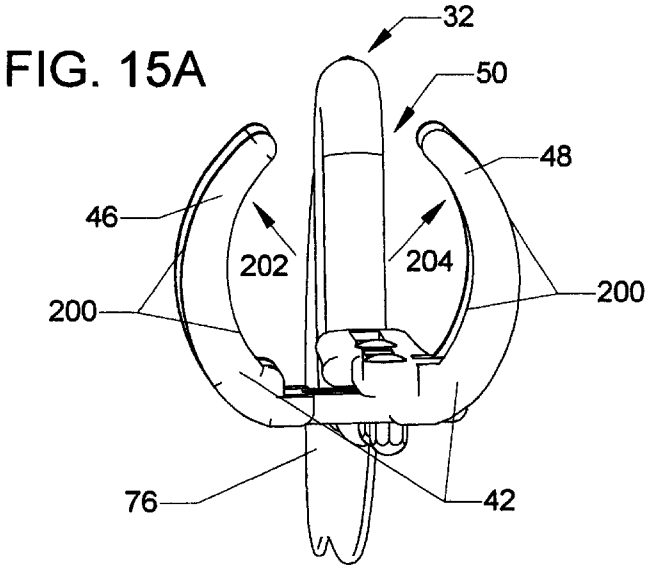

FIG. 15B is an illustration showing an end view of an aquatic propulsion device 32 through the forearm support 42, in which the forearm support 42 includes an upward curve 201 on one end, thereby forming a support opening 50. The support opening's width is increased by the upward curve 201 such that a person's forearm 56 is more easily able to move in and out of the forearm support 42 while retaining the comfort and improved support provided by the curved profile 200. Those of ordinary skill in the art will see that the forearm support 42 may be constructed from many combinations of materials, construction techniques, sizes, shapes, widths, lengths and heights, including variations in the curved profile 200 and the upward curve 201.

Referring again to the aquatic propulsion device 32 exemplified in FIG. 14A and FIG. 14B, the paddle 34 may include a leading edge 70 and a resistive surface 76.

The resistive surface 76 may be rigid enough to compensate for the lack of a rigidifying support 72 of the type shown in FIG. 3. The rigidity and conversely, the flexibility, of the resistive surface 76 can be designed to match the application of the aquatic propulsion device 32 and skill level and/or preferences of a swimmer using the device 32.

Figure 16A:
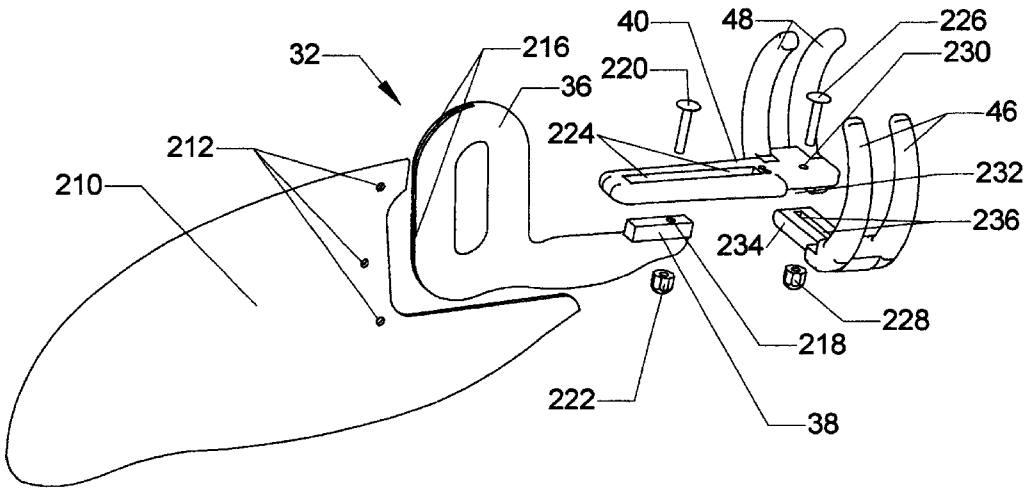
FIGS. 16A and 16B show an exploded perspective view respectively showing structural elements for the aquatic propulsion device of FIGS. 14A, 14B, 14C and 15A.
Figure 16B:
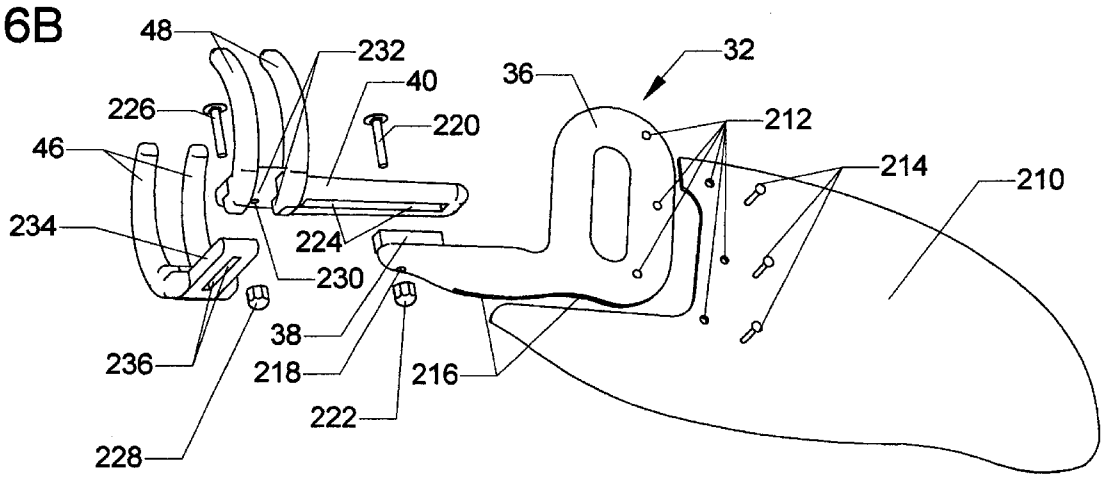

FIG. 16A and FIG. 16B illustrate exploded views of additional details of an aquatic propulsion device 32 constructed in accordance with the present invention. The embodiment shown in FIGS. 16A and 16B includes a removable paddle 210, a hand grip 36, a set of paddle mounting holes 212, a set of paddle mounting screws 214 and a paddle mounting slot 216. The removable paddle 210 attaches to the hand grip 36 by sliding the removable paddle 210 into the paddle mounting slot 216 such that the set of paddle mounting holes 212 in the removable paddle 210 and in the hand grip 36 are aligned and can be secured by the set of paddle mounting screws 214. This facilitates the use of interchangeable removable paddles 210 that may have various characteristics, including, but not limited to, rigidity, flexibility, color, buoyancy, shape and/or size. Those skilled in the art will see that the removable paddle 210 and the hand grip 36 may be attached using many alternate attachment mechanisms including, but not limited to, pins, clamps and/or push button released bindings. Those of ordinary skill in the art will understand that the removable paddle 210 may also be permanently attached to the hand grip 36 using alternate mechanisms including welding, adhesives and/or rivets.

FIG. 16A and FIG. 16B additionally show an embodiment of an aquatic propulsion device 32 in accordance with the present invention that includes a forearm member mount 38, a forearm member mounting hole 218, a forearm member mounting bolt 220, a forearm member mounting nut 222, the elongated forearm member 40 and a elongated forearm member adjustment slot 224. The elongated forearm member 40 may be slidably secured to the forearm member mount 38 by placing the forearm member mount 38 into the elongated forearm member adjustment slot 224 and placing the forearm member mounting bolt 220 through the forearm member mounting hole 218 and securing the forearm member mounting bolt 220 on the underside of the forearm member mount 38 with the forearm member mounting nut 222.

Those of ordinary skill in the art will see that the elongated forearm member 40 is slidably adjustable along extent of the elongated forearm member adjustment slot 224 and the forearm member mount 38. Additionally, by removing the forearm member mounting bolt 220, the elongated forearm member 40 may be removed from the forearm member mount 38 for more compact storage and/or shipping. A resistive action between the forearm member mounting bolt 220, the elongated forearm member 40 and the forearm member mount 38 can be used to secure a desired position of the elongated forearm member 40 lengthwise along a person's forearm 56 (not shown). Those of ordinary skill in the art will see that the resistive action between the elongated forearm member 40 and the forearm member mount 38 can be enhanced with the addition of a rough surface texture or saw orgear like teeth to a under side of the elongated forearm member 40 and a top side of the forearm member mount 38.

Those skilled in the art will further see that in accordance with the present invention numerous other slidably adjustable mechanisms may be used to secure the forearm member mount 38 to the elongated forearm member 40 including insertion of the elongated forearm member 40 within a hole in the forearm member mount 38 using a well known telescoping action, or sliding the elongated forearm member 40 over and/or around a T-shaped groove or ridge in the forearm member mount 38. Those skilled in the art will further recognize that the elongated forearm member 40 can be locked or secured into a position within or upon the forearm member mount 38 using many well known constructions, including, but not limited to, latches, ratcheting action and/or catches.

FIG. 16A and FIG. 16B further illustrate an embodiment of an aquatic propulsion device 32 that includes a forearm support slider bolt 226, a forearm support slider nut 228, a forearm support mounting hole 230, a forearm support slider guide 232, the forearm support front 46, the forearm support back 48, a forearm support slider 234 and a forearm support slider slot 236. The forearm support front 46 is attached to one end of the forearm support slider 234. The forearm support back 48 is attached to an end of the elongated forearm member 40. The forearm support slider 234 may be slidably secured to the elongated forearm member 40 allowing a width-wise adjustment of the forearm support 42. The forearm support slider 234 is placed in the forearm support slider guide 232 and the forearm support slider bolt 226 is placed through the forearm support mounting hole 230 and then into and through the forearm support slider slot 236 and secured with the forearm support slider nut 228.

Those of ordinary skill in the art will see that the forearm support slider 234 is slidably adjustable along extent of the forearm support slider slot 236 and the forearm support slider bolt 226. Additionally, by removing the forearm support slider bolt 226, the forearm support slider 234 and attached forearm support front 46 may be removed from the elongated forearm member 40 for more compact storage and/or shipping. A resistive action between the forearm support slider bolt 226, the elongated forearm member 40 and the forearm support slider 234 can be used to secure a desired position of the elongated forearm member 40 widthwise across a person's forearm 56 (not shown). Those of ordinary skill in the art will see that the resistive action between the elongated forearm member 40 and the forearm support slider 234 can be enhanced with the addition of a rough surface texture or saw or gear like teeth to a under side of the elongated forearm member 40 and a top side of the forearm support slider 234.

Those skilled in the art will further see that in accordance with the present invention numerous other slidably adjustable mechanisms may be used to secure the elongated forearm member 40 to the forearm support slider 234 including insertion of the forearm support slider 234 within a hole in the elongated forearm member 40 using a well known telescoping action, or sliding the forearm support slider 234 over and/or around a T-shaped groove or ridge in the elongated forearm member 40. Those skilled in the art will further recognize that the forearm support slider 234 can be locked or secured into a position within or upon the elongated forearm member 40 using many well known constructions, including, but not limited to, latches, ratcheting action and/or catches.

Figure 17B:
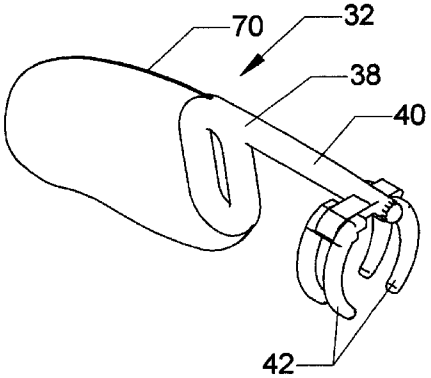
FIGS. 17A, 17B and 17C are a side and perspective views showing a sixth alternate embodiment of an aquatic propulsion device with a forearm member mount and an elongated member positioned in alternate orientations relative to a forearm constructed in accordance with the present invention.
Figure 17A:
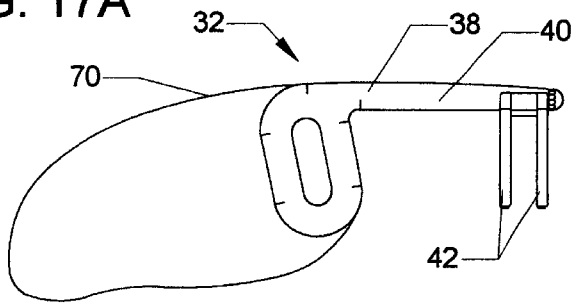

FIG. 17A and FIG. 17B show a side and perspective view, respectively, of an embodiment of an aquatic propulsion device 32 in which the forearm member mount 38 and elongated forearm member 40 are constructed along, aligned, or substantially aligned with respect to a leading edge 70. This embodiment has similar usage characteristics to those of the previously disclosed embodiments the aquatic propulsion device 32; however, it may better fit a desired aesthetic and/or feel of a swimmer using the device 32, such as a person 30 analogous to that shown in FIG. 1. For exemplary purposes, the forearm member mount 38 and elongated forearm member 40 are shown joined in a single unary construction. Those skilled in the art will see that there are any number of embodiments relative to the construction of the forearm member mount 38 and the elongated forearm member 40 along the leading edge 70, including, but not limited to, the various constructions disclosed in the alternate embodiments the aquatic propulsion device 32 as taught by the present invention.

Figure 17C:
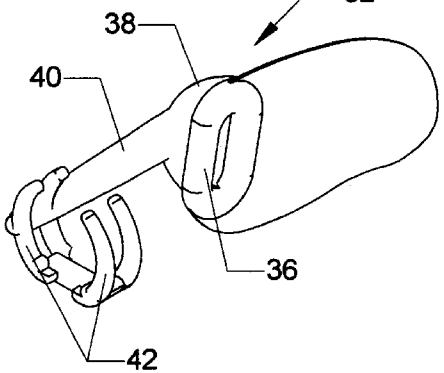

FIG. 17C shows a perspective view of an embodiment of an aquatic propulsion device 32 in which the forearm member mount 38 and elongated forearm member 40 are constructed along, aligned, or substantially aligned with respect to a palm-side of a hand 54, such as the hand 54 shown in FIG. 2. One of ordinary skill in the art will see that the forearm member mount 38 and the elongated forearm member 40 may alternately be constructed along, aligned, or substantially aligned with respect to an opposed palm-side of a hand 54. In another embodiment, the elongated forearm member 40 may be aligned with respect to the leading edge 70 while the forearm member mount 38 may not be; alternatively, the forearm member mount 38 may be aligned with respect to the leading edge 70, while the elongated forearm member 40 may not be. In such embodiments, the elongated forearm member 40 may curve, angle, protrude or bend, making positional transitions with respect to a person's forearm 56. Such positional transitions may aid forearm support and/or force distribution. One of ordinary skill in the are will see that the forearm member mount 38 and elongated forearm member 40 may have any number of positions, shapes, angles and/or curves as taught by the present invention.

Figure 18:
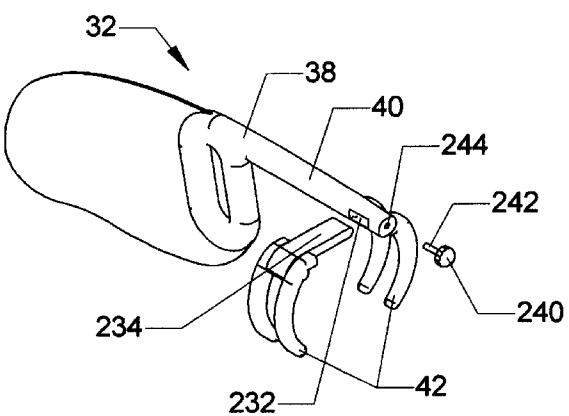
FIG. 18 is a perspective view showing structural elements that facilitate adjustment of a forearm support width of the aquatic propulsion device of FIGS. 17A and 17B.

FIG. 18 is a perspective view showing structural elements that facilitate a widthwise adjustment of a forearm support 42 of the aquatic propulsion device 32 of FIGS. 17A and 17B, and includes a width adjustment knob 240, a width adjustment bolt 242, a threaded width adjustment socket 244, a forearm support slider guide 232 and a forearm support slider 234. The forearm support slider guide 232 may be cut, drilled, formed, and/or otherwise placed in the elongated forearm member 40 proximate the end opposing the forearm member mount 38. The forearm support slider 234 is place into the forearm support slider guide 232 and is slidably adjustable within the forearm support guide 232. The width adjustment bolt 242 is inserted into the threaded width adjustment socket 244.

The width adjustment knob 240 can be used to tighten/loosen the width adjustment bolt 242 within the threaded width adjustment socket 244 such that the width adjustment bolt 242 can lock or bind the forearm support slider 234 into a desired position, thereby allowing a widthwise adjustment of the forearm support 42. Those skilled in the art will see that there are any number of embodiments relative to the construction of the forearm support slider 234 and forearm support slider guide 232, including, but not limited to, using a well known telescoping action, or sliding the forearm support slider 234 over and/or around a T-shaped groove or ridge in the forearm support slider guide 232. Those skilled in the art will further recognize that the forearm support slider 234 can be locked or secured into a widthwise position within the forearm support guide 232 using many well known constructions, including, but not limited to, latches, ratcheting action and/or catches.

Figure 19B:
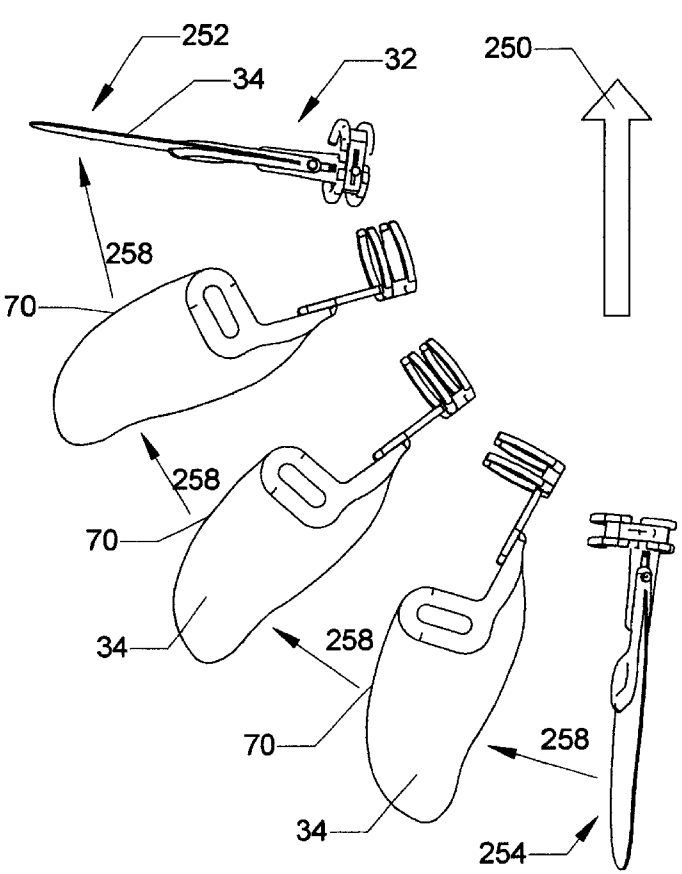
FIGS. 19A and 19B are frontal views showing a motion and flexural pattern of an aquatic propulsion device in accordance with a method of usage of the present invention.
Figure 19A:
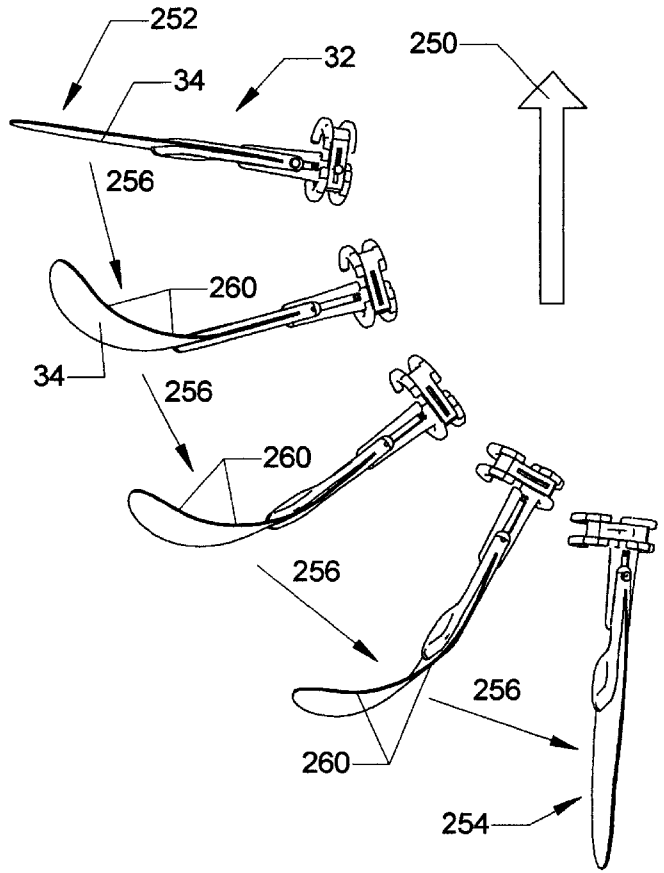

FIGS. 19A and 19B are frontal views showing a motion and a flexural pattern of an aquatic propulsion device in accordance with a method of usage of the present invention. A person 30 such as the swimmer shown in FIG. 1 may alternately employ or perform propulsive, or power, strokes as shown in FIG. 19A, followed by return, or non-power, strokes as shown in FIG. 19B to propel themselves through water in a direction generally along a forward axis or travel path 250. Relative to a propulsive stroke, the aquatic propulsion device 32 moves from an initial propulsive stroke position 252 proximate or above a person's waist or shoulder along the general direction of a propulsive axis or arc 256 to a final propulsive stroke position 254 proximate and beside or in front of a person's thigh or upper leg. This propulsive movement in turn causes the paddle 34, which is oriented or held generally perpendicular to the propulsive axis 256 during the propulsive stroke, to displace a significant amount of water along the direction of the propulsive axis 256, thereby propelling the person 30 forward along forward travel path 250. The person 30 may adjust the particular orientation of the paddle 34, which in turn may adjust the direction of propulsion during use.

A flexing action 260 of the paddle 34 caused by a resistive force of the water against the propulsive movement of the paddle 34 increases the displacement of the water in a direction or path opposite the forward travel path 250, thereby increasing forward propulsion. The flexing action 260 advantageously aids in maintaining forward propulsion as a propulsive stroke is completed because a portion of the paddle 34 remains perpendicular or generally perpendicular to the forward travel path 250 for a longer time than would be the case in the event that the paddle 34 were rigid, thereby aiding water displacement in a direction opposite the forward travel path 250.

The curved nature of the propulsive movement results in an additional, possibly undesired, and smaller or generally smaller water displacement component along a direction or vector generally perpendicular to a forward axis travel path 250. This additional water displacement component may be countered by a similar but mirror image of the propulsive movement of an aquatic propulsion device 32 in the person's other hand. Moreover, the flexing action 260 of the paddle 34 may advantageously decrease an undesired or wasted displacement of the water in a direction or path perpendicular to the forward travel path 250, thereby increasing efficiency and reducing fatigue.

One of ordinary skill in the art will see that a desired flexibility, stiffness, direction and curvature of a flexural characteristic of the paddle 34 may be constructed using well-known mechanisms, individually or in combinations, including, but not limited to, stiffening ridges or fingers, holes, slits or slots, grooves, variations in shape, variations in thickness, and/or choice of materials.

Relative to return strokes, as shown in FIG. 19B, movement of the aquatic propulsion device 32 begins from the final propulsive stroke position 254 and continues along a return path 258, such that the paddle 34 is held or oriented generally parallel to the return path 258 to minimize the amount of water displaced by the aquatic propulsion device 32. A return stroke may effectively return the aquatic propulsion device 32 to an initial propulsive stroke position 252, from which another propulsive stroke may originate. Those skilled in the art will understand that a return stroke may generally retrace some or all of a propulsive stroke, and/or a return stroke may be used to reorient the aquatic propulsion device 32 to a new position prior to a propulsive stroke.

A flexing action of the paddle 34 during a return stroke may not be desired and might cause a wobble or vibration of the aquatic propulsion device 32 during the return stroke. Additionally, a flexing action of the paddle 34 along the leading edge 70 during the return stroke may also not be desired and might interfere with guidance of the aquatic propulsion device 32 during a return stroke. Consequently, the design of the flexural characteristics of the paddle 34 may take into consideration the desired attributes of both the propulsive and return strokes as well as, but not limited to, additional design considerations as disclosed herein.

Figure 20A:
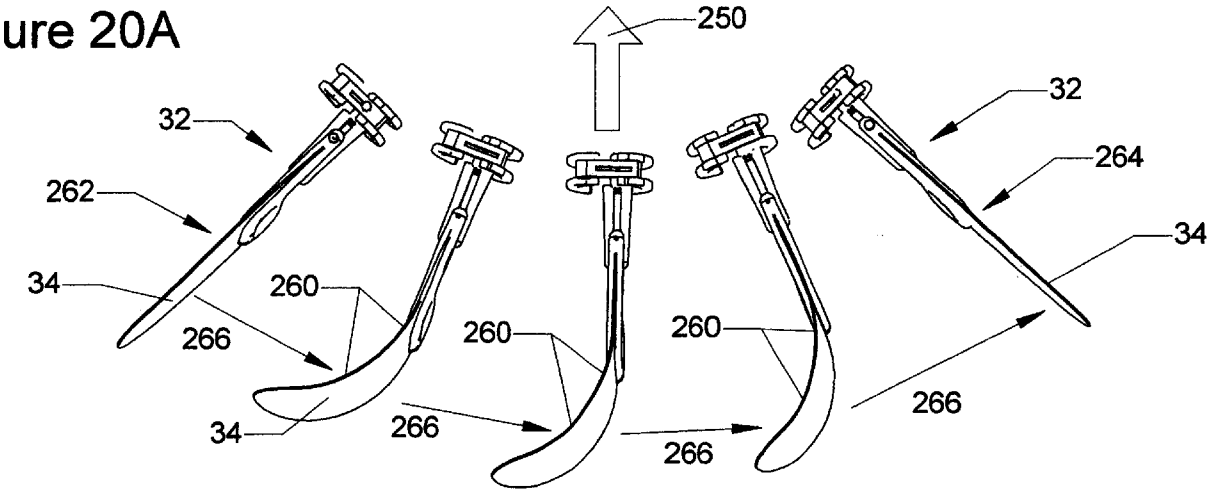
FIGS. 20A and 20B are frontal views showing a motion and flexural pattern of an aquatic propulsion device in accordance with an alternate method of usage of the present invention.
Figure 20B:
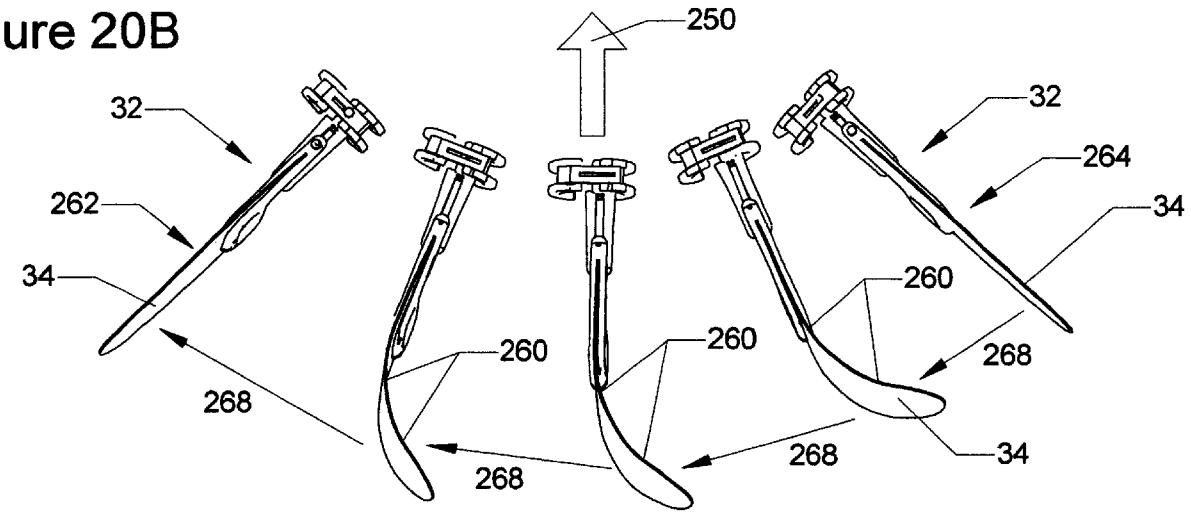

FIGS. 20A and 20B are frontal views showing a motion and a flexural pattern of an aquatic propulsion device 32 in accordance with an alternate method of usage of the present invention. A person 30 such as the swimmer shown in FIG. 1 may alternately employ or perform a left-to-right cruising stroke as shown in FIG. 20A, followed by a right-to-left cruising stroke as shown in FIG. 20B to propel themselves through water in a direction generally along a forward axis or travel path 250. Referring to FIG. 20A, an aquatic propulsion device 32 is positioned in a generally down and left outward direction below a person's waist in a left initial cruising stroke position 262.

Relative to a left-to-right cruising stroke, the aquatic propulsion device 32 moves from the left initial cruising stroke position 262 along the general direction of a left-to-right cruising axis, arc, or travel path 266 to a right final cruising stroke position 264 in generally down and right outward direction below a person's waist. This cruising movement in turn causes the paddle 34, which is oriented or held generally perpendicular to the left-to-right cruising axis 266 during the left-to-right cruising stroke, to displace a significant amount of water along the direction of the left-to-right cruising axis 266, thereby propelling the person 30 forward along forward travel path 250. The person 30 may adjust the particular orientation of the paddle 34, which in turn may adjust the direction of propulsion during use.

A flexing action 260 of the paddle 34 caused by a resistive force of the water against the propulsive movement of the paddle 34 increases the displacement of the water in a direction or path opposite the forward travel path 250, thereby increasing a forward propulsion. Additionally, such propulsive movement causes an additional, possibly undesired, displacement of water in a direction generally perpendicular to a forward axis travel path 250 that may be countered by a similar, but mirror imaged, right-to-left cruising stroke of an aquatic propulsion device 32 in the person's other hand.

Following a left-to-right cruising stroke, the person 30 may begin a right-to-left cruising stroke, as shown in FIG. 20B, to generate further forward propulsion.

Relative to right-to-left cruising strokes, movement of the aquatic propulsion device 32 begins from the final left-to-right cruising stroke position 264 and continues along a return path 268 such that the paddle 34 is held or oriented generally perpendicular to the right-to-left cruising axis 268 during the right-to-left cruising stroke, to displace a significant amount of water along the direction of the right-to-left cruising axis 268, thereby propelling the person 30 forward along forward travel path 250.

A right-to-left cruising stroke may effectively return the aquatic propulsion device 32 to the initial left-to-right cruising stroke position 262 from which another left-to-right cruising stroke may originate. Those skilled in the art will understand that a right-to-left cruising stroke may generally retrace some or all of a left-to-right cruising stroke, and/or a right-to-left cruising stroke may be used to reorient the aquatic propulsion device 32 to a new position prior to a left-to-right cruising stroke.

Figure 21B:
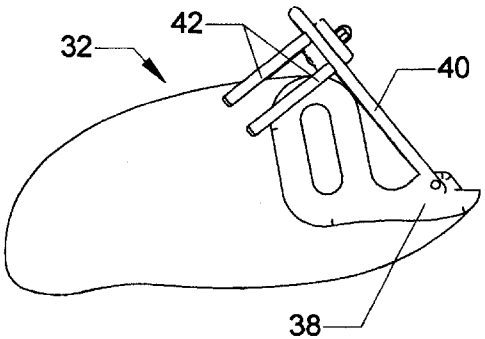
FIGS. 21A, 21B and 21C are a side extended, a side folded and a perspective exploded view respectively showing a seventh alternate embodiment of an aquatic propulsion device constructed in accordance with the present invention.
Figure 21A:
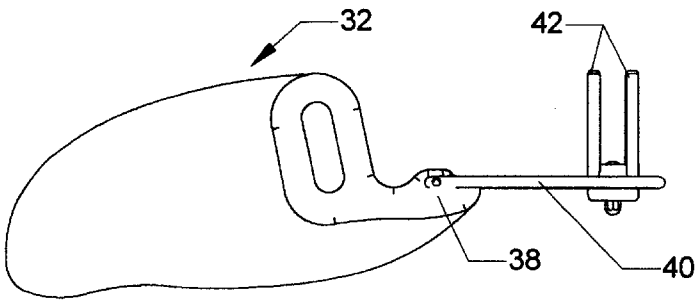
Figure 21C:
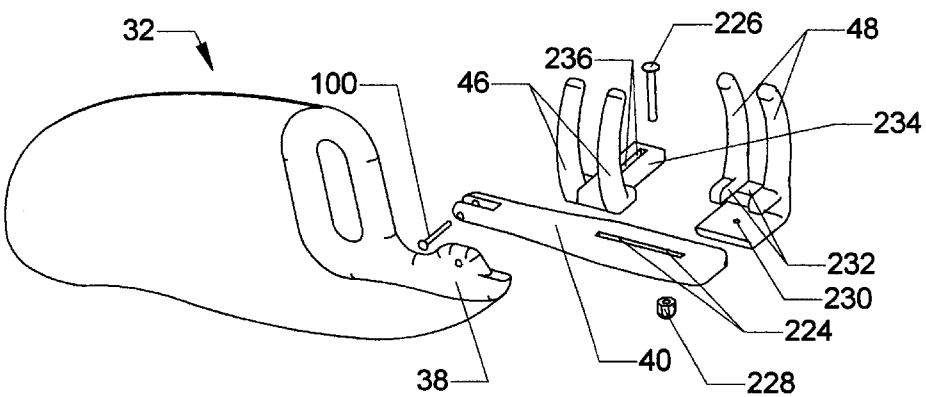

FIGS. 21A and 21B are a side extended and a side folded view respectively showing a seventh alternate embodiment of an aquatic propulsion device 32 constructed in accordance with the present invention in which a length-wise and a width-wise adjustment of a forearm support 42 are positioned, locked and/or secured with a single assembly. Referring also now to FIG. 21C, a perspective exploded view is shown that includes a forearm member mount 38, an elongated forearm member 40, a rotational attachment screw 100, a forearm support 42, a forearm support front 46, a forearm support back 48, an elongated forearm member adjustment slot 224, a forearm support slider bolt 226, a forearm support slider nut 228, a forearm support mounting hole 230, a forearm support slider guide 232, a forearm support slider 234 and a forearm support slider slot 236.

A rotational attachment screw 100 may be used to secure the forearm member mount 38 to the elongated forearm member 40. The elongated forearm member 40 may be length-wise and width-wise slidaby secured to the forearm support 42 using the elongated forearm member adjustment slot 224, the forearm support slider bolt 226 and the forearm support slider nut 228. The forearm support back 48 is positioned or aligned with the elongated forearm member 40 such that the forearm support slider hole 230 is place below, or on the under side, of the elongated forearm member 40 and is inline with the elongated forearm member adjustment slot 224, and the forearm support slider guide 232 is place above, or on top of, the elongated forearm member 40. The forearm support front 46 is positioned or aligned above, or on top of, the elongated forearm member 40 and placed into the forearm support slider guide 232. The forearm support slider bolt 226 is placed through the forearm support slider slot 236, then through the elongated forearm member adjustment slot 224 and finally through the forearm support mounting hole 230 and secured with the forearm support slider nut 228.

Those of ordinary skill in the art will see that the forearm support slider 234 is width-wise slidably adjustable along extent of the forearm support slider slot 236 and the forearm support slider bolt 226. Those of ordinary skill in the art will further see that the elongated forearm member 40 is length-wise slidably adjustable along extent of the elongated forearm member adjustment slot 224 and the forearm support slider bolt 226. Those skilled in the art will recognize that the forearm support 42 can be locked or secured into a position within or upon the elongated forearm member 40 using many well known constructions, including, but not limited to, latches, ratcheting action and/or catches.

Figure 22:
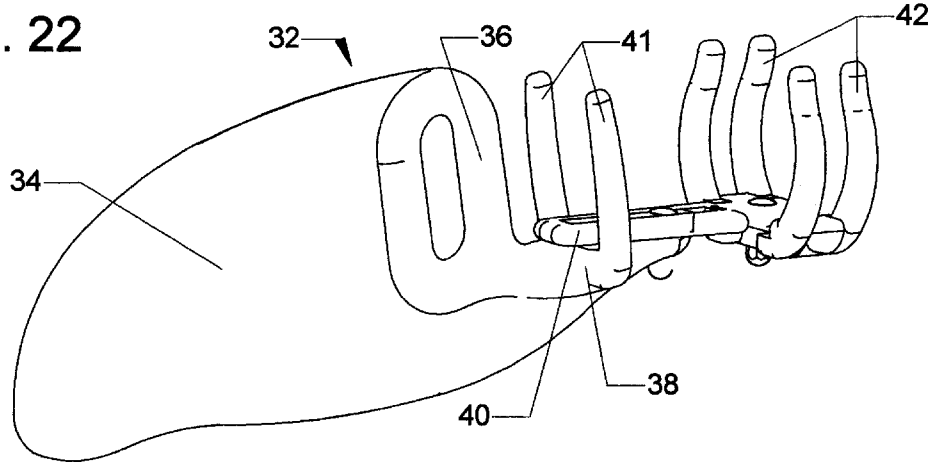
FIG. 22 is a perspective view showing an eighth alternate embodiment of an aquatic propulsion device constructed in accordance with the present invention.

FIG. 22 is a perspective view showing an eighth alternate embodiment of an aquatic propulsion device 32 constructed in accordance with the present invention that includes a wrist support 41 or a second support 41 for a person's forearm. Depending on usage, aesthetics, and/or construction techniques, the wrist support 41 may be secured to either the forearm member mount 38 or the elongated forearm member 40. Those of ordinary skill in the art will see that there are many ways in which to secure the wrist support 41 to either the forearm member mount 38 or the elongated forearm member 40 including, but not limited to, constructed as a single unary piece, welding and/or bolting. One skilled in the art will further see that the wrist support 41 may also be adjustably secured to either the forearm member mount 38 or the elongated forearm member 40 using, but not limited to, latches, catches, bolts and/or other mechanisms as taught in accordance with the principles herein.

The wrist support 41 serves as a fulcrum for the leveraging of forces between the paddle 34 and the forearm support 42. The fulcrum action of the wrist support 41 reduces the forces required by the person's hand 54, as shown in FIG. 1, against a hand grip 36 when employing the aquatic propulsion device 32. Those of ordinary skill in the art will see that the wrist support 41 may be constructed in many combinations of materials, construction techniques, sizes, shapes, widths, lengths and/or heights.

Figure 23:
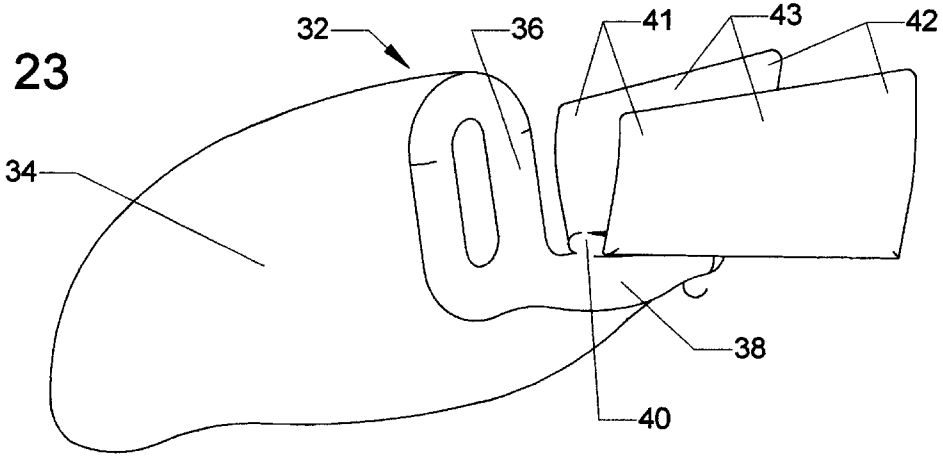
FIG. 23 is a perspective view showing a ninth alternate embodiment of an aquatic propulsion device constructed in accordance with the present invention.

FIG. 23 is a perspective view showing a ninth alternate embodiment of an aquatic propulsion device 32 constructed in accordance with the present invention that includes an elongated forearm support 43. Depending on usage, aesthetics, and/or construction techniques, the elongated forearm support 43 may be secured to either the forearm member mount 38 or the elongated forearm member 40. Those of ordinary skill in the art will see that there are many ways in which to secure the elongated forearm support 43 to either the forearm member mount 38 or the elongated forearm member 40 including, but not limited to, constructed as a single unary piece, welding and/or bolting. One skilled in the art will further see that the elongated forearm support 43 may also be adjustably secured to either the forearm member mount 38 or the elongated forearm member 40 using, but not limited to, latches, catches, bolts and other mechanisms as taught by various embodiments of the present invention.

The elongated forearm support 43 provides a combination of wrist and forearm support characteristics of both the wrist support 41 and the forearm support 42 as taught by alternate embodiments of the present invention. Those of ordinary skill in the art will see that the elongated forearm support 43 may be constructed using many combinations of materials, construction techniques, sizes, shapes, widths, lengths and/or heights.

While certain exemplary embodiments have been described and shown in the accompanying drawings, it is to be understood that such embodiments are merely illustrative and not restrictive of the current invention, and that elements of said embodiments may be combined in part or whole, and that this invention is not restricted to the specific constructions and arrangements shown and described since a wide range of modifications may occur by those ordinarily skilled in the art. The description herein provides for such modifications, and is limited only by the following claims.

What is claimed is:

1. An aquatic propulsion device comprising:

an elongate member;

a forearm support to be worn on a forearm of a person, the forearm support secured to a first portion of the elongate member, the forearm support including a first portion having a curved generally c-shaped profile;

a grip secured to a second portion of the elongate member; and a paddle secured to the grip, wherein a person can place a forearm in the forearm support and can reach and hold onto the grip with a hand and move the grip with the hand such that the forearm support, the elongate member, and the paddle move in tandem with the hand and the forearm, wherein a combination of the forearm support, the elongate member, the grip, and the paddle is characterized by a center of water displacement extending beyond the hand away from the forearm in a direction generally indicated by a line from a portion of the forearm support toward a portion of the grip, the center of water displacement offset relative to a midpoint of the grip in a direction generally indicated by a line from a thumb-side of the hand toward a fourth-finger-side of the hand.

2. The aquatic propulsion device of claim 1, wherein the forearm support is slidably adjustable to accommodate a variety of forearm widths.

3. The aquatic propulsion device of claim 1, wherein the grip is secured to the elongate member in a slidably adjustable manner to accommodate a variety of forearm lengths.

4. The aquatic propulsion device of claim 1, wherein the paddle is secured to the grip in a removable manner.

5. The aquatic propulsion device of claim 1, wherein the paddle is flexible.

6. The aquatic propulsion device of claim 1, wherein the forearm support includes a second portion having a shape that is different than the first portion of the forearm support.

7. The aquatic propulsion device of claim 1, wherein the grip and the elongate member are formed from a single piece of material.

8. The aquatic propulsion device of claim 1, wherein a portion of the elongate member runs along a portion of the forearm on a thumb-side of the hand when the forearm is placed in the forearm support and the hand holds onto the grip.

9. The aquatic propulsion device of claim 1, wherein a portion of the elongate member runs along a portion of the forearm opposite a thumb-side of the hand when the forearm is placed in the forearm support and the hand holds onto the grip.

10. The aquatic propulsion device of claim 1, wherein a portion of the elongate member runs along a portion of the forearm on a palm-side of the hand when the forearm is placed in the forearm support and the hand holds onto the grip.

11. The aquatic propulsion device of claim 1, wherein a portion of the elongate member runs along a portion of the forearm opposite a palm-side of the hand when the forearm is placed in the forearm support and the hand holds onto the grip.

12. An aquatic propulsion device comprising:

an elongate member;

a forearm support to be worn on a forearm of a person, the forearm support secured to a first portion of the elongate member, the forearm support including a first portion having a curved generally c-shaped profile and a second portion having a generally straight profile;

a grip secured to a second portion of the elongate member; and a paddle secured to the grip, wherein a person can place a forearm in the forearm support and can reach and hold onto the grip with a hand and move the grip with the hand such that the forearm support, the elongate member, and the paddle move in tandem with the hand and the forearm, wherein a combination of the forearm support, the elongate member, the grip, and the paddle is characterized by a center of water displacement extending beyond the hand away from the forearm in a direction generally indicated by a line from a portion of the forearm support toward a portion of the grip, the center of water displacement offset relative to a midpoint of the grip in a direction generally indicated by a line from a thumb-side of the hand toward a fourth-finger-side of the hand.

13. The aquatic propulsion device of claim 12, wherein the forearm support is slidably adjustable to accommodate a variety of forearm widths.

14. The aquatic propulsion device of claim 12, wherein the grip is secured to the elongate member in a slidably adjustable manner to accommodate a variety of forearm lengths.

15. The aquatic propulsion device of claim 12, wherein the paddle is secured to the grip in a removable manner.

16. The aquatic propulsion device of claim 12, wherein the paddle is flexible.

17. The aquatic propulsion device of claim 12, wherein the grip and the elongate member are formed from a single piece of material.

18. The aquatic propulsion device of claim 12, wherein a portion of the elongate member runs along a portion of the forearm on a thumb-side of the hand when the forearm is placed in the forearm support and the hand holds onto the grip.

19. The aquatic propulsion device of claim 12, wherein a portion of the elongate member runs along a portion of the forearm opposite a thumb-side of the hand when the forearm is placed in the forearm support and the hand holds onto the grip.

20. The aquatic propulsion device of claim 12, wherein a portion of the elongate member runs along a portion of the forearm on a palm-side of the hand when the forearm is placed in the forearm support and the hand holds onto the grip.

21. The aquatic propulsion device of claim 12, wherein a portion of the elongate member runs along a portion of the forearm opposite a palm-side of the hand when the forearm is placed in the forearm support and the hand holds onto the prig.

22. An aquatic propulsion device comprising:

an elongate member;

a forearm support to be worn on a forearm of a person, the forearm support secured to a first portion of the elongate member in a slidably adjustable manner to accommodate a variety of forearm lengths;

a grip secured to a second portion of the elongate member; and a paddle secured to the grip, wherein a person can place a forearm in the forearm support and can reach and hold onto the grip with a hand and move the grip with the hand such that the forearm support, the elongate member, and the paddle move in tandem with the hand and the forearm, wherein a combination of the forearm support, the elongate member, the grip, and the paddle is characterized by a center of water displacement extending beyond the hand away from the forearm in a direction generally indicated by a line from a portion of the forearm support toward a portion of the grip, the center of water displacement offset relative to a midpoint of the grip in a direction generally indicated by a line from a thumb-side of the hand toward a fourth-finger-side of the hand.

23. The aquatic propulsion device of claim 22, wherein the forearm support includes a portion having a curved generally c-shaped profile.

24. The aquatic propulsion device of claim 22, wherein the forearm support is slidably adjustable to accommodate a variety of forearm widths.

25. The aquatic propulsion device of claim 24, further comprising an adjustable securing device that maintains a forearm support position with respect to the elongate member and maintains a forearm support width.

26. The aquatic propulsion device of claim 25, wherein the securing device comprises a single shaft.

27. The aquatic propulsion device of claim 22, wherein the grip is secured to the elongate member in a selectably rotatable manner.

28. An aquatic propulsion device comprising:

an elongate member;

a first forearm support to be worn on a forearm of a person, the first forearm support secured to a first portion of the elongate member;

a grip secured to a second portion of the elongate member;

a second forearm support to be worn on the forearm of the person, the second forearm support secured to at least one from the group of the grip and a third portion of the elongate member;

a paddle secured to the grip, wherein a person can place a forearm in the first and second forearm supports and can reach and hold onto the grip with a hand and move the grip with the hand such that the first and second forearm supports, the elongate member, and the paddle move in tandem with the hand and the forearm.

29. The aquatic propulsion device of claim 28, wherein the first forearm support and the second forearm support have different shapes.

30. An aquatic propulsion device comprising:

an elongate member;

a forearm support to be worn on a forearm of a person, the forearm support secured to a first portion of the elongate member;

a grip secured to a second portion of the elongate member;

a wrist support to be worn on a wrist of the person, the wrist support secured to at least one from the group of the grip and a third portion of the elongate member;

a paddle secured to the grip, wherein a person can place a wrist in the wrist support and place a forearm in the forearm support, and can reach and hold onto the grip with a hand and move the grip with the hand such that the wrist support, the forearm support, the elongate member, and the paddle move in tandem with the hand and the forearm.

31. An aquatic propulsion device comprising:

an elongate member having a length;

a forearm support to be worn on a forearm of a person, the forearm support having at least one side secured along a majority of the elongate member's length;

a grip secured to the elongate member; and a paddle secured to the grip, wherein a person can place a forearm in the forearm support and can reach and hold onto the grip with a hand and move the grip with the hand such that the forearm support, the elongate member, and the paddle move in tandem with the hand and the forearm wherein a combination of the forearm support, the elongate member, the grip, and the paddle is characterized by a center of water displacement extending beyond the hand away from the forearm in a direction generally indicated by a line from a portion of the forearm support toward a portion of the grip, the center of water displacement offset relative to a midpoint of the grip in a direction generally indicated by a line from a thumb-side of the hand toward a fourth-finger-side of the hand.

32. The aquatic propulsion device of claim 31, wherein the forearm support forms a cuff.

33. An aquatic propulsion device comprising:

an elongate member;

a forearm support to be worn on a forearm of a person, the forearm support secured to a first portion of the elongate member;

a grip secured to a second portion of the elongate member; and a paddle secured to the grip, wherein a person can place a forearm in the forearm support and can reach and hold onto the grip with a hand and move the grip with the hand such that the forearm support, the elongate member, and the paddle move in tandem with the hand and the forearm, wherein a combination of the forearm support, the elongate member, the grip, and the paddle is characterized by a center of water displacement extending beyond the hand away from the forearm in a direction generally indicated by a line from a portion of the forearm support toward a portion of the grip, the center of water displacement offset relative to a midpoint of the grip in a direction generally indicatd by a line from a thumb-side of the hand toward a fourth-finger-side of the hand.

* * * * *